US012195296B2

(12) United States Patent
Okazaki

(10) Patent No.: US 12,195,296 B2
(45) Date of Patent: Jan. 14, 2025

(54) SHEET FEEDING APPARATUS AND IMAGE FORMING APPARATUS

(71) Applicant: CANON KABUSHIKI KAISHA, Tokyo (JP)

(72) Inventor: Shunsuke Okazaki, Shizuoka (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 129 days.

(21) Appl. No.: 17/705,950

(22) Filed: Mar. 28, 2022

(65) Prior Publication Data

US 2022/0315363 A1 Oct. 6, 2022

(30) Foreign Application Priority Data

Apr. 6, 2021 (JP) ..... 2021-064531

(51) Int. Cl.
*B65H 3/06* (2006.01)
*B65H 5/06* (2006.01)
*B65H 5/16* (2006.01)

(52) U.S. Cl.
CPC ..... *B65H 5/16* (2013.01); *B65H 5/062* (2013.01); *B65H 2801/06* (2013.01)

(58) Field of Classification Search
CPC ..... B65H 3/0684; B65H 3/0669; B65H 2404/1421; B65H 5/062; G03G 15/6514; G03G 15/6511
See application file for complete search history.

(56) References Cited

U.S. PATENT DOCUMENTS

| | | | | |
|---|---|---|---|---|
| 10,087,023 | B2 | 10/2018 | Fujioka et al. | |
| 2008/0122162 | A1 | 5/2008 | Bokelman | |
| 2010/0301543 | A1 | 12/2010 | Ueyama | |
| 2018/0079609 | A1* | 3/2018 | Fujioka | B65H 3/0669 |
| 2018/0088510 | A1* | 3/2018 | Fujioka | B65H 3/0669 |
| 2022/0127090 | A1* | 4/2022 | Tateishi | B65H 3/0684 |
| 2022/0382208 | A1* | 12/2022 | Tateishi | H04N 1/00551 |

FOREIGN PATENT DOCUMENTS

| | | | |
|---|---|---|---|
| JP | 2000302258 | A | 10/2000 |
| JP | 2010275079 | A | 12/2010 |
| JP | 2011046484 | A | 3/2011 |
| JP | 2018052701 | A | 4/2018 |
| JP | 2019131328 | A | 8/2019 |

* cited by examiner

*Primary Examiner* — Luis A Gonzalez
(74) *Attorney, Agent, or Firm* — ROSSI, KIMMS & McDOWELL LLP

(57) ABSTRACT

A sheet feeding apparatus includes an urging mechanism configured to urge a holding member such that a feeding member is brought into contact with an upper surface of a sheet loaded on a sheet loading member by the holding member. The urging mechanism includes a swinging member, a pressing member, and an urging member. The urging mechanism is configured to urge the holding member such that (i) a force by which the feeding member presses an upper surface of a sheet in a first state in which a distance between a loading surface and the feeding member is a first distance is larger than (ii) a force by which the feeding member presses an upper surface of a sheet in a second state in which the distance between the loading surface and the feeding member is a second distance longer than the first distance.

20 Claims, 11 Drawing Sheets

SHEET FEEDING APPARATUS AND IMAGE FORMING APPARATUS

BACKGROUND OF THE INVENTION

Field of the Invention

The present invention relates to a sheet feeding apparatus that feeds a sheet, and an image forming apparatus that forms an image on the sheet.

Description of the Related Art

An image forming apparatus, such as a printer, a copier, or a multifunction printer, includes a sheet feeding apparatus that feeds a sheet used as a recording medium or a document by a feed roller (also referred to as a pickup roller). Japanese Patent Application Laid-open No. 2011-46484 discloses that a feed roller is attached to a tip of a swingable movable arm, and the feed roller contacts a sheet stack by a restoring force of a spring member attached to the movable arm.

By the way, in the configuration in which a separation nip for conveying a sheet while separating the sheet fed by the feed roller is located at a position higher than a loading surface on which the sheet is loaded, a guide portion inclined upward from the loading surface toward the separation nip is provided. In this case, as the stacking amount of sheets on the loading surface decreases, the distance that the sheet climbs a slope of the guide portion during sheet feeding increases, and a conveyance resistance of the sheet tends to increase.

However, in a method of pressurizing the feed roller disclosed in the above document, as the stacking amount of sheets decreases, a deformation amount of a spring member decreases and the restoring force also decreases, therefore a contact pressure of the feed roller with respect to the sheet decreases. Therefore, in a case where the pressurization method of the above document is used in the configuration in which the sheet climbs the slope of the guide portion during sheet feeding, there is a possibility that feeding failure occurs in the state in which the stacking amount of sheets is small.

SUMMARY OF THE INVENTION

The present invention provides a sheet feeding apparatus and an image forming apparatus that can reduce a possibility of feeding failure.

According to one aspect of the invention, a sheet feeding apparatus includes a sheet loading member including a loading surface on which a sheet is loaded, a feeding member configured to feed the sheet loaded on the sheet loading member in a sheet feeding direction and disposed above the loading surface, a holding member configured to hold the feeding member and move the feeding member toward and away from the loading surface, an urging mechanism configured to urge the holding member such that the feeding member is brought into contact with an upper surface of the sheet loaded on the sheet loading member by the holding member, a conveyance unit disposed downstream of the feeding member in the sheet feeding direction, the conveyance unit including a separation nip by which the sheet fed from the feeding member is conveyed while being separated one by one, and a guide portion configured to guide a leading end of the sheet fed by the feeding member to the separation nip such that the leading end is guided upward from upstream to downstream in the sheet feeding direction, wherein the urging mechanism includes a swinging member connected to the holding member, a pressing member configured to press the swinging member, and an urging member configured to urge the pressing member, wherein the swinging member and the holding member are configured to swing around a same swinging axis, wherein the holding member is configured to be urged in a direction in which the feeding member is brought into contact with the upper surface of the sheet in a case where the pressing member urged by the urging member presses the swinging member, and wherein the urging mechanism is configured to urge the holding member such that (i) a force by which the feeding member presses an upper surface of a sheet in a first state in which a distance between the loading surface and the feeding member is a first distance is larger than (ii) a force by which the feeding member presses an upper surface of a sheet in a second state in which the distance between the loading surface and the feeding member is a second distance longer than the first distance.

According to another aspect of the invention, a sheet feeding apparatus includes a sheet loading member including a loading surface on which a sheet is loaded, a feeding member configured to feed the sheet loaded on the sheet loading member in a sheet feeding direction and disposed above the loading surface, a holding member configured to hold the feeding member and move the feeding member toward and away from the loading surface, an urging mechanism configured to urge the holding member such that the feeding member is brought into contact with an upper surface of the sheet loaded on the sheet loading member by the holding member, a conveyance unit disposed downstream of the feeding member in the sheet feeding direction, the conveyance unit including a separation nip by which the sheet fed from the feeding member is conveyed while being separated one by one, and a guide portion configured to guide a leading end of the sheet fed by the feeding member to the separation nip such that the leading end is guided upward from upstream to downstream in the sheet feeding direction, wherein the urging mechanism includes a swinging member configured to swing together with the holding member about a swinging axis of the holding member, and a weight attached to the swinging member, wherein the holding member is configured to be urged in a direction in which the feeding member is brought into contact with the upper surface of the sheet by the swinging member being urged due to a gravity acting on the weight, and wherein the urging mechanism is configured to urge the holding member such that (i) a force by which the feeding member presses an upper surface of a sheet in a first state in which a distance between the loading surface and the feeding member is a first distance is larger than (ii) a force by which the feeding member presses an upper surface of a sheet in a second state in which the distance between the loading surface and the feeding member is a second distance longer than the first distance.

Further features of the present invention will become apparent from the following description of exemplary embodiments with reference to the attached drawings.

DESCRIPTION OF THE EMBODIMENTS

Hereinafter, embodiments according to the present disclosure will be described with reference to the drawings.

In the following embodiment and the drawings, a vertical direction in a case where an image forming apparatus is installed on a horizontal plane is defined as a Z direction. A rotation axis direction of a photosensitive drum included in the image forming apparatus is defined as an X direction, and a direction intersecting the X direction and the Z direction is defined as a Y direction. The X direction is a main scanning direction at the time of image formation, and is also a sheet width direction perpendicular to a sheet conveyance direction inside the image forming apparatus. The X direction, the Y direction, and the Z direction are directions intersecting each other, and are preferably orthogonal to each other. In addition, a shape, an arrangement, or the like of a member attachable to and detachable from the image forming apparatus will be described using the X direction, the Y direction, and the Z direction with reference to a position and posture in a state of being mounted on the image forming apparatus.

First Embodiment

Figure 1:
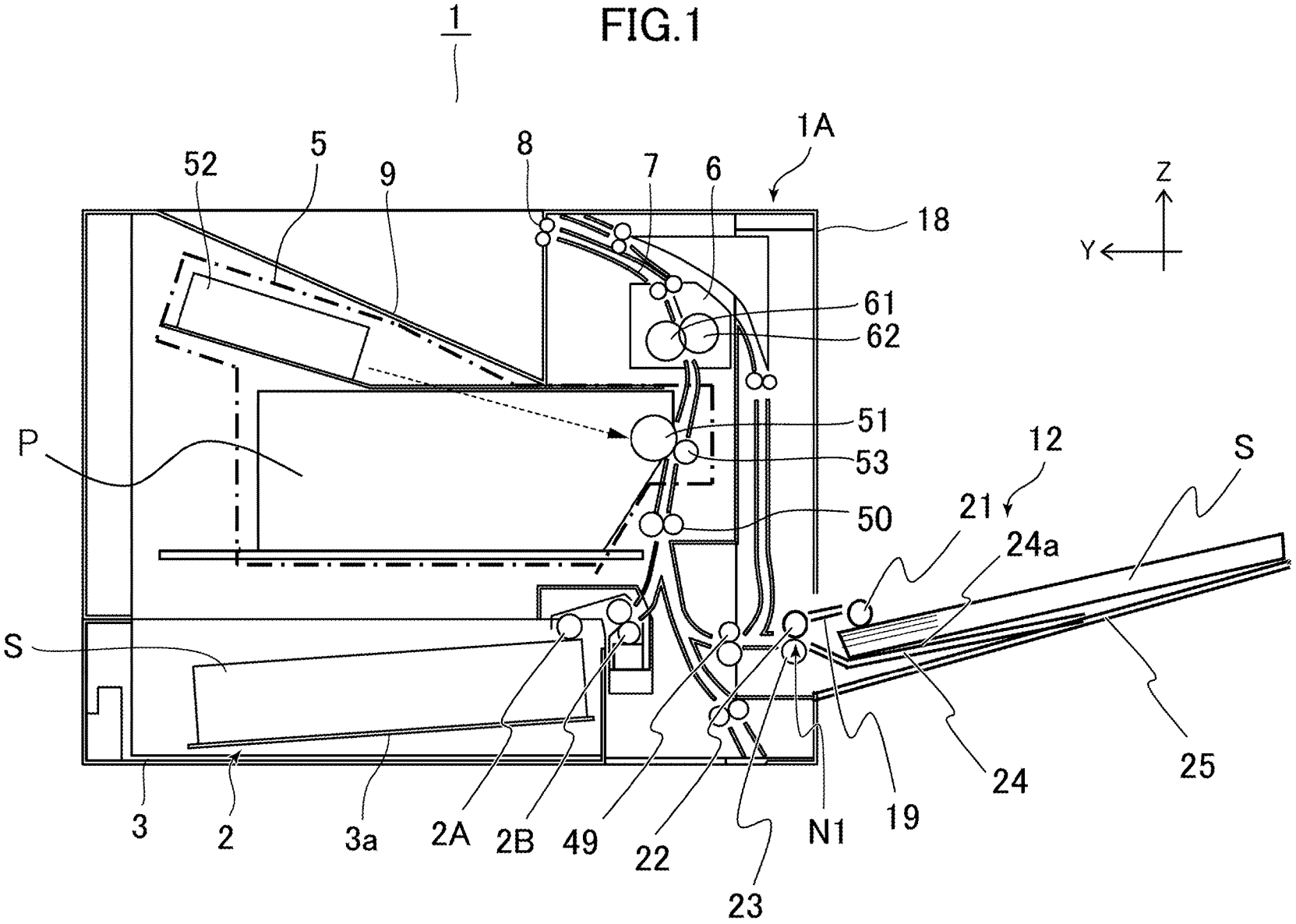
FIG. 1 is a schematic view of an image forming apparatus according to a first embodiment.

First, an outline of an image forming apparatus 1 according to a first embodiment will be described with reference to FIG. 1. FIG. 1 is a cross-sectional view illustrating an overall configuration of the image forming apparatus 1. The image forming apparatus 1 is an electrophotographic printer that forms an image on a sheet S by an electrophotographic process based on image information input from an external device. As the sheet S as a recording material, various sheets having different sizes and materials, such as paper such as plain paper and thick paper, a plastic film, cloth, a sheet material subjected to surface treatment such as coated paper, and a sheet material having a special shape such as an envelope or index paper, can be used.

The image forming apparatus 1 includes an image forming unit 5, a manual feed unit 12, and a cassette feed unit 2. The image forming unit 5 includes a process cartridge P, a laser scanner 52, and a transfer roller 53. The process cartridge P is a cartridge attachable to and detachable from an apparatus body 1A of the image forming apparatus 1. The process cartridge P includes a photosensitive drum 51 as an image bearing member (electrophotographic photosensitive member), and a charger and a developing unit as a process unit acting on the photosensitive drum 51, and houses developer containing toner in a cartridge casing. Note that the apparatus body 1A refers to a part of the image forming apparatus 1 excluding the process cartridge P and a feed cover 25, a feed tray 24, and a feed unit 19 of the manual feed unit 12 which will be described below.

Hereinafter, a flow of an image forming operation by the image forming apparatus 1 will be described. When an image forming command is input to the image forming apparatus 1, the image forming unit 5 performs an electrophotographic process. That is, the photosensitive drum 51 starts to rotate, and the charger uniformly charges a surface of the photosensitive drum 51 with a predetermined polarity and potential. The laser scanner 52 irradiates the photosensitive drum 51 with a laser beam based on the image information input to the image forming apparatus 1 to perform exposure processing, and writes an electrostatic latent image on the surface of the photosensitive drum 51. The electrostatic latent image is developed by a developing unit using developer and visualized as a toner image (image) borne on the photosensitive drum 51.

In parallel with the electrophotographic process in the image forming unit 5, the sheets S are fed one by one from the manual feed unit 12 or the cassette feed unit 2. Details of the manual feed unit 12 will be described below. The cassette feed unit 2 includes a cassette 3 that is a storage member that can be pulled out from the apparatus body 1A of the image forming apparatus 1, a feed unit 2A that feeds the sheet S stacked on a lift plate 3*a* of the cassette 3, and a separation roller 2B. The configuration of the feed unit 2A and the separation roller 2B is similar to the configuration including the feed unit 19 and the separation roller 23 in the manual feed unit 12.

The sheet S fed from the manual feed unit 12 or the cassette feed unit 2 abuts against a registration roller pair 50 in the stopped state and is subjected to skew correction. Thereafter, the registration roller pair 50 conveys the sheet S to a transfer unit that is a nip portion between the photosensitive drum 51 and the transfer roller 53 at timing synchronized with the process in the image forming unit 5. In the transfer unit, a bias voltage having a polarity opposite to the normal charge polarity of the toner is applied to the transfer roller 53, thereby the toner image borne on the photosensitive drum 51 is transferred to the sheet S.

A fixing unit 6 forms a fixing nip by a heating unit 61 including a fixing film and a ceramic heater as a heating body or the like that is disposed on an inner peripheral side of the fixing film, and a press roller 62 as a pressing member in pressure contact with the heating unit 61. When the sheet S passes through the fixing nip, the toner image on the sheet is heated and pressurized, and the toner is melted and then fixed, thereby the unfixed image is permanently fixed to the sheet S. The sheet S having passed through the fixing unit 6 is discharged to the outside of the apparatus body 1A by a discharge roller pair 8 via a discharge path 7, and is stacked on a discharge tray 9.

Manual Feed Unit

Figure 2:
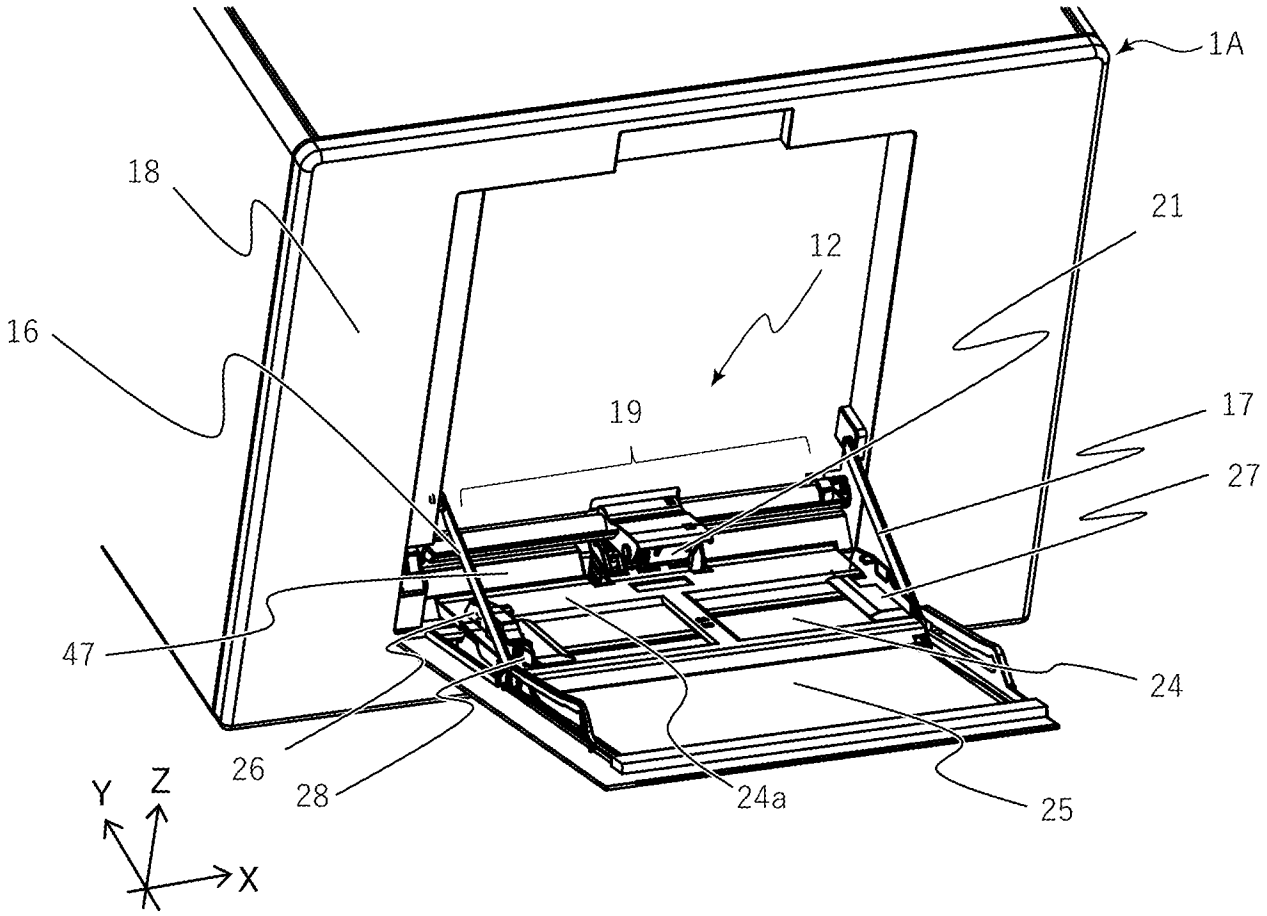
FIG. 2 is a perspective view of a manual feed unit according to the first embodiment.

The manual feed unit 12 (also referred to as a multi-purpose feed unit) which is the sheet feeding apparatus of the first embodiment will be further described. As illustrated in FIGS. 1 and 2, the manual feed unit 12 is provided on a side portion of the apparatus body 1A in the Y direction. The manual feed unit 12 includes a feed cover 25, a feed tray 24, a feed roller 21, a conveyance roller 22, and a separation roller 23.

The feed tray 24 which is a sheet loading member on which sheets are stacked is supported by the feed cover 25. The feed cover 25 is an opening/closing member that is openable and closable with respect to a side surface cover 18 constituting a side surface of the apparatus body 1A in the Y direction. Specifically, a support portion provided in a lower portion of the feed cover 25 is rotatably supported by the apparatus body 1A, thereby the feed cover 25 rotates about the axis extending in the X direction. As a result, the feed cover 25 is movable to a closed position where the feed cover 25 is substantially vertical when viewed in the X direction and forms the side surface of the apparatus body 1A together with the side surface cover 18, and an open position (a position in FIGS. 1 and 2) where the feed cover 25 protrudes in the Y direction with respect to the side surface cover 18. In a state in which the feed cover 25 is located at the open position, the feed tray 24 is located on an upper portion of the feed cover 25, and the user can place the sheet S on the loading surface 24*a* which is the upper surface of the feed tray 24.

In addition, both outer sides of the feed cover 25 in the X direction with respect to the feed tray 24 are connected to the side surface cover 18 by links 16 and 17. The links 16 and 17 have a function of regulating the rotation of the feed cover 25 beyond the open position and supporting the weight of the feed tray 24 and the sheet S.

As illustrated in FIG. 2, the feed tray 24 is provided with side regulating plates 26 and 27 as a pair of regulating members that regulate an end position of the sheet S loaded on the loading surface 24*a* in the width direction (X direction). The side regulating plates 26 and 27 are movable toward and away from each other in the X direction, and are positioned by a lock mechanism provided on a back side of the loading surface 24*a* of the feed tray 24. The user unlocks the lock by operating an operation lever 28 provided on one side regulating plate 26, slides the side regulating plates 26 and 27 according to the width (length in the X direction) of the sheet S, and then releases the hand from the operation lever 28. As a result, the sheet S is positioned in the X direction (width direction) by the side regulating plates 26 and 27.

As illustrated in FIGS. 1 and 2, the feed roller 21, which serves as a pickup roller, is disposed above the loading surface 24*a* of the feed tray 24, and rotates in contact with the upper surface of the sheet S loaded on the loading surface 24*a* to feed the uppermost sheet S in a sheet feeding direction Fd. The sheet feeding direction Fd is a direction of a frictional force applied to the sheet S by the feed roller 21 on the contact surface with the sheet S, and is a direction substantially parallel to the loading surface 24*a*. The conveyance roller 22 and the separation roller 23 are conveyance units that form a separation nip N1 for separating the sheet S and convey the sheet S fed by the feed roller 21 while separating the sheet S in the separation nip N1. The separation roller 23 applies a frictional force in a direction opposite to the sheet feeding direction Fd to the sheet S to pass through the separation nip N1, thereby restricting the sheet S other than the uppermost sheet S from passing through the separation nip N1. The sheet S having passed through the separation nip N1 is conveyed toward the registration roller pair 50 by a conveyance roller pair 49 (FIG. 1). Note that the feed roller 21 is an example of a feeding member, and for example, a belt stretched around a rotating roller can be used as the feeding member.

The separation roller 23 is an example of a separation member, and for example, a roller member attached to a shaft fixed to the apparatus body 1A via a torque limiter can be used. In addition, as the separation roller 23, the roller member attached to the shaft to which driving force in a rotation direction against the sheet feeding direction Fd is input from a motor disposed in the apparatus body 1A via the torque limiter can be used. Further, instead of the separation roller 23, a pad-shaped elastic member that contacts the conveyance roller 22 may be used as the separation member.

Figure 6A:
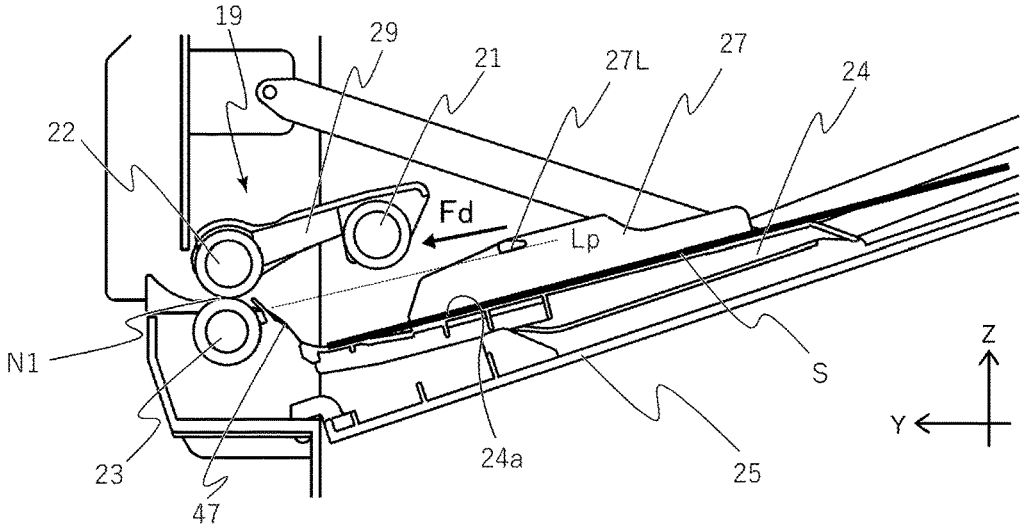
FIGS. 6A to 6C are each a cross-sectional view of a manual feed unit illustrating a process of a feeding operation according to the first embodiment.
Figure 6B:
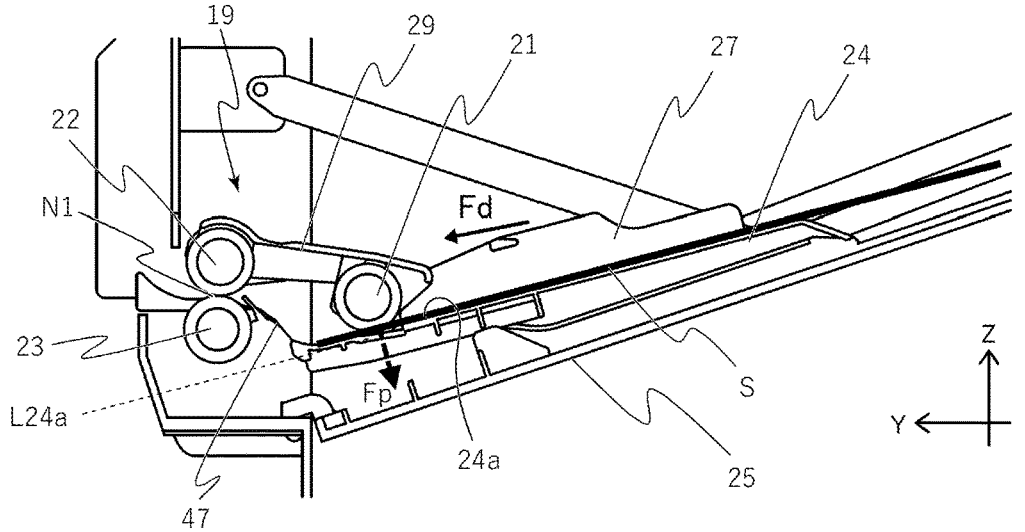

Here, a conveyance guide 47 (FIG. 2) as a guide portion that guides a leading end of the sheet S fed by the feed roller 21 toward the separation nip N1 is provided upstream of the separation nip N1 in the sheet feeding direction Fd. The conveyance guide 47 will be described as being provided in the apparatus body 1A, but may be provided, for example, at a downstream end in the sheet feeding direction Fd of the feed tray 24. The conveyance guide 47 is configured to guide the leading end of the sheet S fed by the feed roller 21 upward to the separation nip N1. In other words, the conveyance guide 47 is configured to guide the leading end of the sheet S such that the leading end of the sheet S is directed upward with respect to the downstream end of the loading surface 24*a* in the conveyance direction of the sheet S. As illustrated in FIG. 6B, when viewed in the X direction, at least a part of the conveyance guide 47 is inclined upward from upstream to downstream in the sheet feeding direction Fd with respect to an extension line L24*a* of the loading surface 24*a*. The extension line L24*a* of the loading surface 24*a* is a straight line that passes through a contact position P1 where the feed roller 21 comes into contact with the loading surface 24*a* in a state in which the sheet S is not stacked on the feed tray 24 and is drawn along the loading surface 24*a* at the contact position P1.

Since the inclined conveyance guide 47 is provided, the leading end of the sheet S fed by the feed roller 21 moves upward along an inclination of the conveyance guide 47 along with the movement in the sheet feeding direction Fd and reaches the separation nip N1. The conveyance guide 47 serves to guide the sheet S to smoothly reach the separation nip N1 in a state in which the stacking amount of the sheet S on the feed tray 24 decreases and a height of the leading end of the uppermost sheet S becomes lower than the position of the separation nip N1. In addition, the conveyance guide 47 serves to make it difficult for the lower sheet S to reach the separation nip N1 by rubbing with the leading end of the lower sheet S that is dragged by the uppermost sheet S to move to the separation nip N1 and applying a resistance force.

An inclination angle of the conveyance guide 47 with respect to the extension line L24*a* of the loading surface 24*a* is not particularly limited, but when the inclination angle is too small, it is difficult to obtain the above-described function, and when the inclination angle is too large, the leading end of the sheet S is caught, which may cause the conveyance failure. As an example, on the path side where the sheet S is conveyed to the separation nip N1, the angle between the loading surface 24*a* and the conveyance guide 47 is preferably 115° or more and 155° or less, and is 135° in the first embodiment. The direction of the loading surface 24*a* in defining the above angle can be said to be a direction parallel to the paper surface direction (direction perpendicular to the direction in which the sheets S are stacked) of the sheet S in the case where the sheet S is stacked on the loading surface 24*a*. In other words, it is preferable that the conveyance guide 47 is inclined at an angle of 20° or more and 80° or less at the maximum with respect to the extension line L24*a* of the loading surface 24*a* in the direction in which the sheet S approaches the separation nip N1.

Feed Unit

Figure 3:
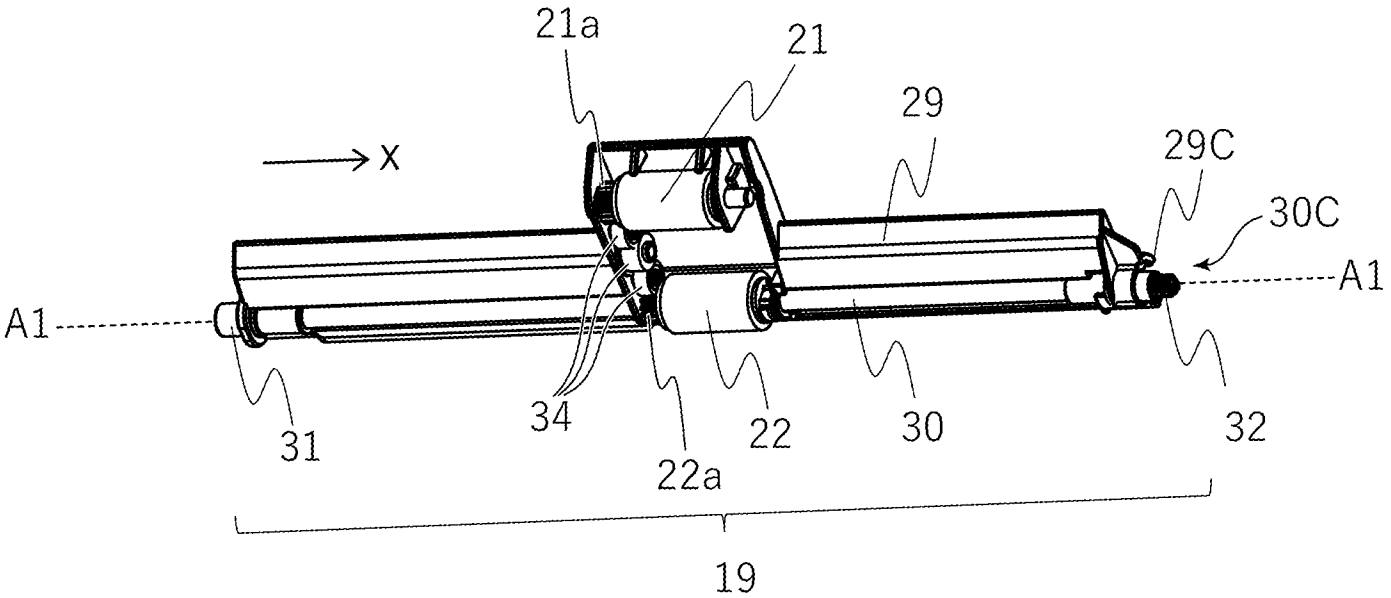
FIG. 3 is a perspective view of a feed unit according to the first embodiment.

Details of the feed unit 19 will be further described with reference to FIG. 3. The feed unit 19 is a unit in which the feed roller 21, the conveyance roller 22, and a holding mechanism thereof are integrated. The feed unit 19 includes a feed arm 29, a feed shaft 30, and an idler gear 34, in addition to the feed roller 21 and the conveyance roller 22.

The conveyance roller 22 is attached to the feed shaft 30 and rotates integrally with the feed shaft 30. The feed shaft 30 is a shaft member extending in the X direction which is a rotation axis direction. One end portion of the feed shaft 30 in the X direction is held by the feed arm 29 via a bearing 31 so as to be relatively rotatable. A drive connection portion 30C connected to a feed drive mechanism 19D to be described below is provided on the other end side of the feed shaft 30 in the X direction. The drive connection portion 30C includes a feed coupling 32 and an arm engaged portion 29C as input members to which the driving force is input from the feed drive mechanism 19D. The arm engaged portion 29C is a part of the feed arm 29, and rotatably holds the feed coupling 32 provided at an end portion of the feed shaft 30. The drive connection portion 30C includes a bearing that is provided on a side opposite to the bearing 31 in the X direction and allows the feed arm 29 to rotatably hold the feed shaft 30.

The feed arm 29 is swingable with respect to the apparatus body 1A about an axis A1 which is the rotation axis of the feed shaft 30. That is, an axis A1 is the rotation axis of the feed shaft 30 as a drive shaft, and is also a swinging axis of the feed arm 29 as the holding member. Due to the swing of the feed arm 29, the feed roller 21 held by the feed arm 29 moves toward and away from the feed tray 24.

The idler gear 34 as a drive transmission unit that transmits driving force from the feed shaft 30 to the feed roller 21 is rotatably supported by the feed arm 29 in a state of being meshed with each other. The idler gear 34 connects a gear 22*a* provided at an end portion of the conveyance roller 22 in the X direction and a gear 21*a* provided at an end portion of the feed roller 21 in the X direction. Therefore, the conveyance roller 22 rotates by the rotation of the feed shaft 30, and the rotation of the feed shaft 30 is transmitted to the feed roller 21 via the gear 22*a*, the idler gear 34, and the gear 21*a*, thereby the feed roller 21 rotates.

Figure 4A:
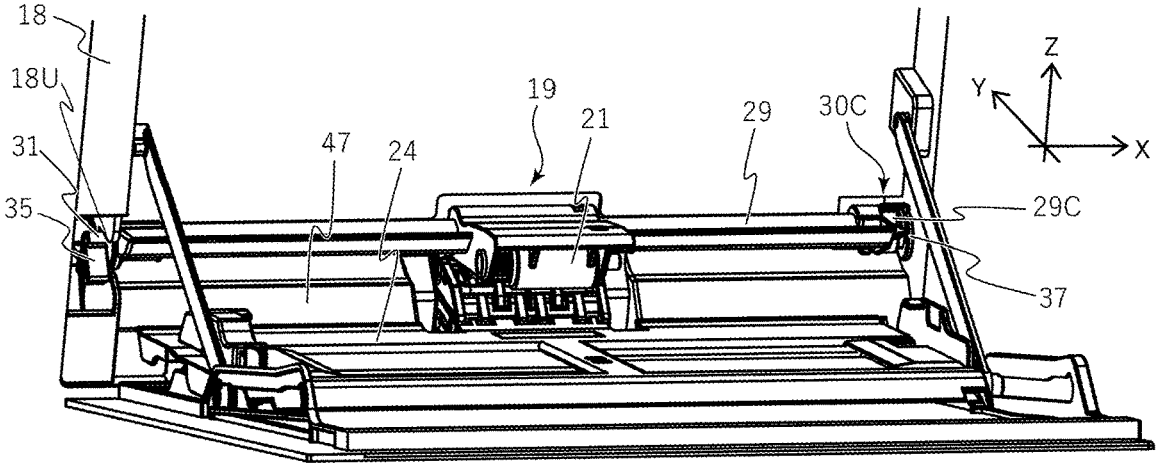
FIGS. 4A to 4C are each a diagram for describing a configuration related to attachment and detachment of the feed unit according to the first embodiment.
Figure 4B:
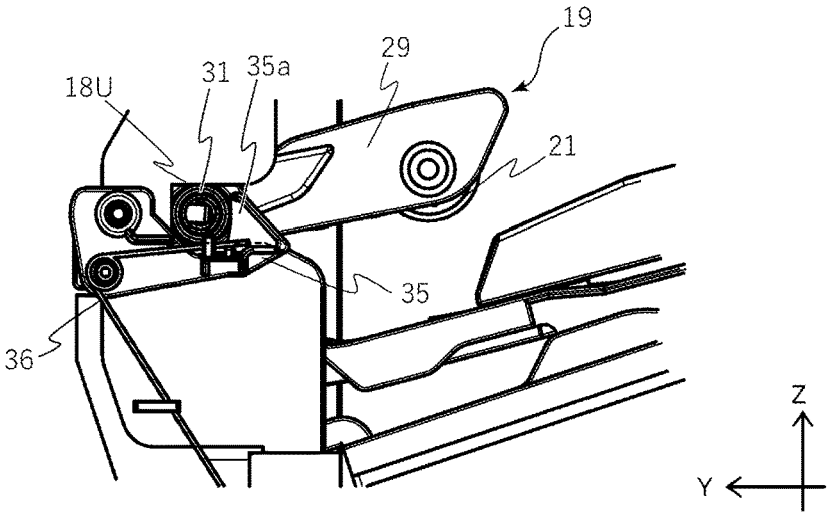
Figure 4C:
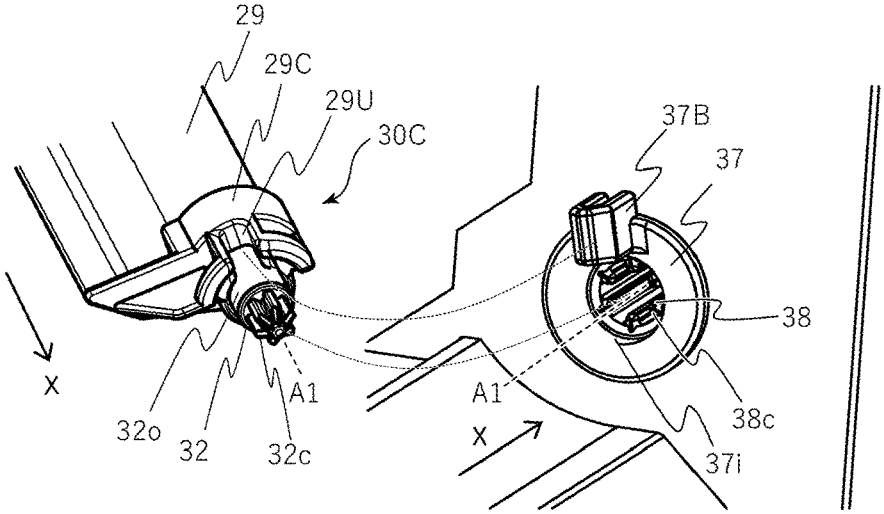

Next, a configuration in which the feed unit 19 is supported by the apparatus body 1A will be described with reference to FIGS. 4A to 4C. FIG. 4A is a perspective view of the feed unit 19 attached to the apparatus body 1A. FIG. 4B is a cross-sectional view of the periphery of the bearing 31 of the feed unit 19 when viewed in the X direction. FIG. 4C is a schematic diagram illustrating a correspondence relationship between the feed coupling 32 of the feed unit 19 and a feed drive gear 38 and a feed pressure lever 37 which are drive output units of the apparatus body 1A.

As illustrated in FIG. 4A, in the feed unit 19, the bearing 31 is held by the apparatus body 1A on one end side in the X direction, and the drive connection portion 30C is held by the apparatus body 1A on the other end side in the X direction. The bearing 31 is engaged with a groove 18U provided in the side surface cover 18 of the apparatus body 1A. As illustrated in FIG. 4B, when viewed in the X direction, the groove 18U has a groove shape opened toward the outside (right side in the drawing) of the apparatus body 1A in the Y direction. Further, a latch 35 which serves as a locking member receiving an urging force from the torsion spring 36 is provided near the groove 18U. In a state in which the bearing 31 is held inside the groove 18U, a tip portion 35*a* of the latch 35 contacts the side surface of the bearing 31 in the Y direction to regulate the bearing 31 from detaching from the groove 18U in the Y direction.

As illustrated in FIG. 4C, the drive connection portion 30C is provided on the other end side of the feed unit 19 in the X direction. The drive connection portion 30C includes the feed coupling 32 provided on the axis A1 of the feed shaft 30 and the arm engaged portion 29C provided on the outer peripheral side of the feed coupling 32 in a radial direction around the axis A1. The arm engaged portion 29C is a substantially cylindrical member centered on the axis A1, and is fitted into the substantially cylindrical feed coupling 32 so as to be relatively rotatable. The arm engaged portion 29C is a part of the feed arm 29, and the feed coupling 32 is formed integrally with the feed shaft 30 or attached to the feed shaft 30 so as to rotate integrally with the feed shaft 30.

The feed drive gear 38 and the feed pressure lever 37 are provided on the apparatus body 1A side as output members of a feed drive mechanism 19D to be described below. The feed drive gear 38 is a coupling member that engages with the feed coupling 32, and the feed pressure lever 37 is an engaging member that engages with the arm engaged portion 29C. The feed pressure lever 37 and the feed drive gear 38 rotate about the same axis A1 as the feed shaft 30. In addition, the feed pressure lever 37 is a substantially cylindrical member provided on the outer peripheral side of the feed drive gear 38, and is fitted into the feed drive gear 38 so as to be relatively rotatable.

A cylindrical outer peripheral surface 32*o* of the feed coupling 32 is fitted into a cylindrical inner peripheral surface 37*i* of the feed pressure lever 37. In addition, a coupling portion 32*c* to be engaged with the coupling portion 38*c* of the feed drive gear 38 is provided at a tip of the feed coupling 32 in the X direction. The coupling portion 32*c* of the feed coupling 32 moves in the X direction which is the rotation axis direction of the feed shaft 30 to be coupled (engaged) and disconnected (disengaged) with/from the coupling portion 32*c* of the feed drive gear 38. When the feed coupling 32 and the feed drive gear 38 are connected, in a sheet feeding operation to be described below, driving force from a driving source disposed in the apparatus body 1A is transmitted to the feed shaft 30 and further transmitted from the feed shaft 30 to the conveyance roller 22 and the feed roller 21.

In addition, the arm engaged portion 29C is provided with a groove 29U as an engaged portion to be engaged with the feed pressure lever 37. The feed pressure lever 37 is provided with a boss 37B as an engaging portion, and the boss 37B is fitted to the groove 29U, so that the feed arm 29 will rotate integrally with the feed pressure lever 37 around the feed shaft 30. That is, the feed pressure lever 37 is connected to the feed arm 29, and the feed pressure lever 37 and the feed arm 29 integrally swing around the common axis (i.e., same swinging axis) A1. As a result, in the sheet feeding operation to be described below, the feed arm 29 swings by the driving force from the driving source arranged in the apparatus body 1A. It is transmitted to the feed shaft 30, and is further transmitted from the feed shaft 30 to the conveyance roller 22 and the feed roller 21.

When the feed unit 19 is attached to the apparatus body 1A, first, the feed unit 19 is aligned such that the arm engaged portion 29C and the feed coupling 32 of the drive connection portion 30C are aligned with the feed pressure lever 37 and the feed drive gear 38 of the apparatus body 1A on the axis A1. At this point, the bearing 31 on the opposite side of the drive connection portion 30C is not fitted to the groove 18U. Then, by moving the feed unit 19 in the X direction, the arm engaged portion 29C is engaged with the feed pressure lever 37, and the feed coupling 32 is engaged with the feed drive gear 38. Thereafter, the feed unit 19 is pressed in the Y direction, and the bearing 31 is pushed into the groove 18U against the urging force of the torsion spring 36. When the bearing 31 passes through the tip portion 35*a* of the latch 35 and is held inside the groove 18U, the mounting of the feed unit 19 is completed.

When the feed unit 19 is detached from the apparatus body 1A, the latch 35 is pressed with a finger to unlock the bearing 31, and the feed unit 19 is pulled out in the Y direction to detach the bearing 31 from the groove 18U. Thereafter, by moving the feed unit 19 in the X direction, the arm engaged portion 29C can be separated from the feed pressure lever 37, and the feed coupling 32 can be separated from the feed drive gear 38.

In the configuration example illustrated in FIG. 4C, the coupling portions 32*c* and 38*c* constitute a coupling or shaft coupling of a so-called spline-engagement. That is, the coupling portion 32*c* of the feed coupling 32 includes a plurality of protrusions or keys extending in the rotation axis direction of the feed shaft 30, and the coupling portion 38*c* of the feed drive gear 38 includes a plurality of grooves or key grooves that receive the plurality of protrusions. Note that, as the coupling portions 32*c* and 38*c*, another coupling mechanism (for example, a dog clutch) that engages and disengages by the movement of the feed coupling 32 in the X direction may be used.

Further, in the illustrated configuration example, the groove 29U is a recessed shape (i.e., key groove) in which a part of an end surface on the feed pressure lever 37 side of the arm engaged portion 29C in the X direction is recessed in the X direction, and the boss 37B is a protrusion (i.e., key) extending in the X direction. Note that the specific configurations of the engaging portion and the engaged portion are not limited to those described above as long as the feed arm 29 rotates integrally with the feed pressure lever 37 in the engaged state.

Feed Drive Mechanism

Figure 5B:
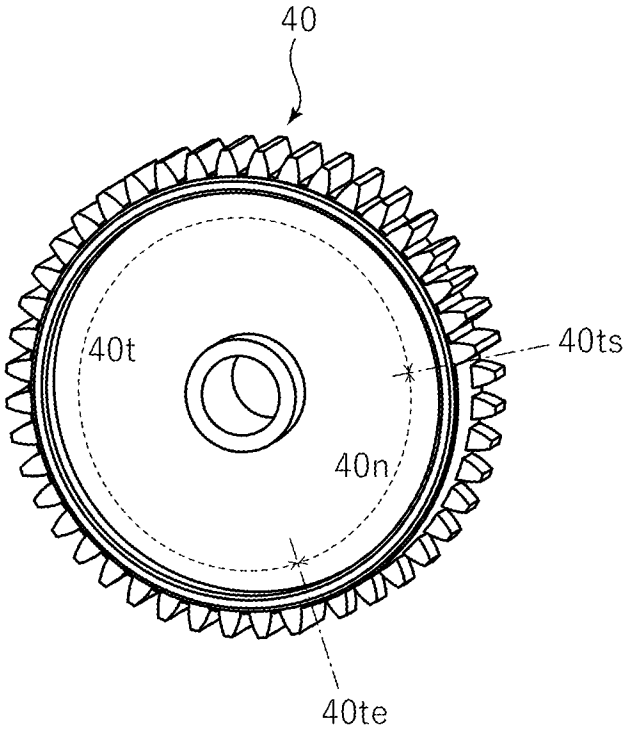
FIG. 5B is a perspective view of a partially-toothless gear constituting the feed drive mechanism.
Figure 5A:
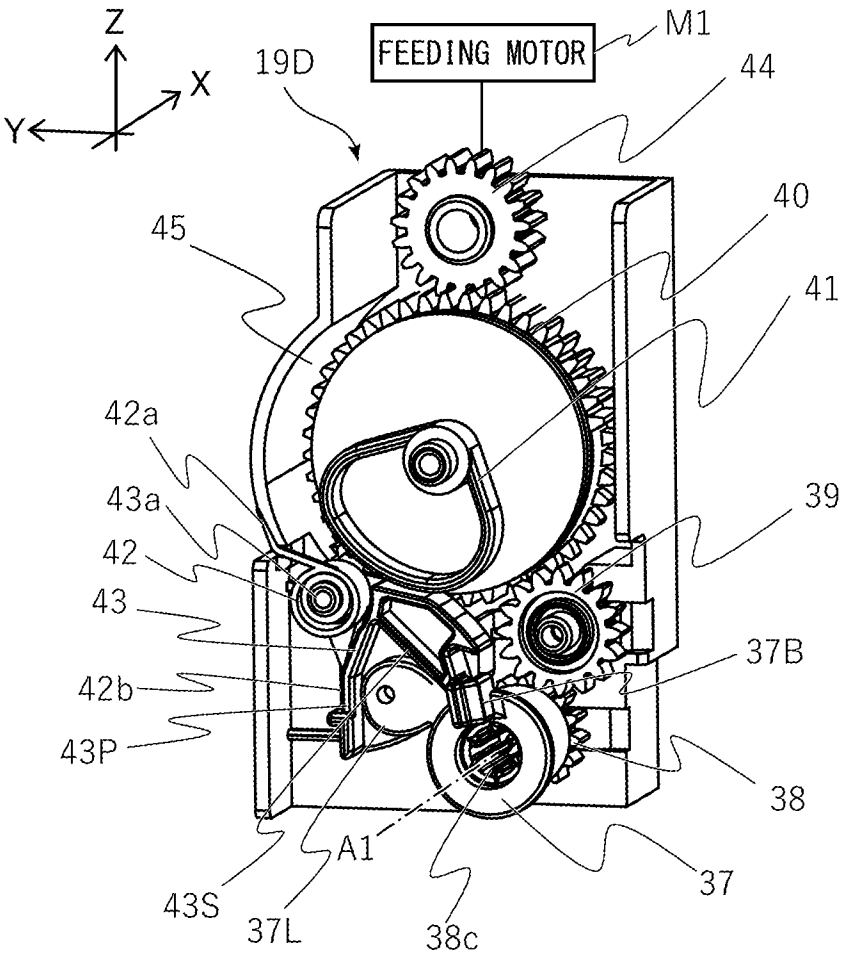
FIG. 5A is a perspective view of a feed drive mechanism according to the first embodiment.

Next, the feed drive mechanism 19D for driving the feed unit 19 will be described with reference to FIGS. 5A and 5B. FIG. 5A is a perspective view of the feed drive mechanism 19D disposed inside the side surface cover 18 (i.e., inside the apparatus body 1A). FIG. 5B is a perspective view of a partially-toothless gear 40 which is a component of the feed drive mechanism 19D.

As illustrated in FIG. 5A, the feed drive mechanism 19D includes an input gear 44, a partially-toothless gear 40, an idler gear 39, the feed drive gear 38, a control cam 41, a pressure arm 43, a torsion spring 42, and the feed pressure lever 37. Each of these members is supported by a drive frame 45 fixed to a frame body of the apparatus body 1A so as to be rotatable about each rotation axis.

The feed drive mechanism 19D rotates the control cam 41 that controls the swinging operation of the feed roller 21, the conveyance roller 22, and the feed arm 29 by the driving force supplied from the common driving source. The feed drive mechanism 19D has a drive transmission path for transmitting driving force to the feed shaft 30 of the feed unit 19 via the feed drive gear 38. The drive transmission path is used for an operation of rotationally driving the feed roller 21 and the conveyance roller 22. A feed motor M1 as the common driving source is disposed in the apparatus body 1A. The drive transmission path includes the input gear 44, the partially-toothless gear 40, the idler gear 39, and the feed drive gear 38. That is, in the first embodiment, the swinging operation of the feed arm 29 is controlled using the driving force of the feed motor M1 which is a driving source for driving the feed roller 21 and the conveyance roller 22. Therefore, the cost can be reduced as compared with a configuration in which a motor or the like for swinging the feed arm 29 is separately arranged.

First, the drive transmission path to the feed shaft 30 of the feed drive mechanism 19D will be described. The input gear 44 is coupled to the feed motor M1 and is rotationally driven in a predetermined rotation direction R1 by the feed motor M1. The partially-toothless gear 40 meshes with the input gear 44 and always rotates in conjunction with the input gear 44. In the partially-toothless gear 40, in a toothless region 40*n* (FIG. 5B) from a predetermined start position 40*ts* to an end position 40*te*, a part of a gear tooth in a tooth width direction (X direction which is a rotation axis direction of the partially-toothless gear 40) is missing.

The gear teeth of the idler gear 39 are provided within a range in the X direction where the gear teeth of the partially-toothless gear 40 are missing in the toothless region 40*n*, and are arranged at positions meshing with a toothed region 40*t* of the partially-toothless gear 40. Therefore, when the toothed region 40*t* other than the toothless region 40*n* of the partially-toothless gear 40 faces the idler gear 39, the partially-toothless gear 40 and the idler gear 39 mesh with each other. When the toothless region 40*n* of the partially-toothless gear 40 faces the idler gear 39, the meshing between the partially-toothless gear 40 and the idler gear 39 is released. The feed drive gear 38 has a gear portion 38*a* that meshes with the gear teeth of the idler gear 39. The gear portion 38*a* rotates integrally with the coupling portion 38*c* described above. Therefore, when the input gear 44 continuously rotates, the feed drive gear 38 performs an intermittent operation of rotating during a period in which the toothed region 40*t* of the partially-toothless gear 40 meshes with the idler gear 39, and stopping during a period in which the toothless region 40*n* of the partially-toothless gear 40 faces the idler gear 39.

Next, a configuration of the feed drive mechanism 19D for swinging the feed arm 29 will be described. The configuration for swinging the feed arm 29 includes the input gear 44, the partially-toothless gear 40, the control cam 41, the pressure arm 43, the torsion spring 42, and the feed pressure lever 37. The control cam 41 is a cam member that is provided on the side surface of the partially-toothless gear 40 and rotates integrally with the partially-toothless gear 40. The control cam 41 has a cam surface that contacts the pressure arm 43, and the cam surface is eccentric with respect to the rotation center of the partially-toothless gear 40 when viewed in the X direction.

The pressure arm 43 is supported by the drive frame 45 so as to be swingable about the support shaft 43*a*, centering on an axis parallel to the axis A1 of the feed pressure lever 37. The pressure arm 43 includes a separation rib (separation pressing portion, retraction pressing portion, or second pressing portion) 43S and a pressure rib (pressurized pressing portion, feeding pressing portion, or first pressing portion) 43P that can contact the lever portion 37L of the feed pressure lever 37, respectively. The lever portion 37L of the feed pressure lever 37 is located between the separation rib 43S and the pressure rib 43P in the circumferential direction of the pressure arm 43 with respect to the support shaft 43*a*. Therefore, the lever portion 37L, the separation rib 43S, and the pressure rib 43P can be disposed in a small space.

When the separation rib 43S presses the lever portion 37L, the feed pressure lever 37 rotates in a counterclockwise direction in the drawing, which is a rotation direction when the feed arm 29 is raised. When the pressure rib 43P presses the lever portion 37L, the feed pressure lever 37 rotates in a clockwise direction in the drawing, which is a rotation direction (that is, the direction in which the feed roller 21 comes into contact with the sheet S on the feed tray 24) in the case where the feed arm 29 descends. When the pressure rib 43P presses the lever portion 37L, the feed roller 21 moves in a direction approaching the loading surface 24*a*. When the separation rib 43S presses the lever portion 37L, the feed roller 21 moves in a direction separated from the loading surface 24*a*. When viewed in the direction of the swinging axis (or rotation axis) of the feed pressure lever 37, the swing direction (or rotation direction) of the feed pressure lever 37 is opposite to the swing direction (or rotation direction) of the pressure arm 43.

A torsion coil spring (hereinafter referred to as a torsion spring 42) is attached to the support shaft 43*a* of the pressure arm 43. One end 42*a* of the torsion spring 42 is fixed to the drive frame 45, and the other end 42*b* thereof is attached to the pressure arm 43. The torsion spring 42 urges the pressure arm 43 in the counterclockwise direction in the drawing. That is, the torsion spring 42 urges the pressure arm 43 in the rotation direction of the pressure arm 43 in the case where the pressure rib 43P presses the lever portion 37L of the feed pressure lever 37 to make the feed arm 29 descend. The control cam 41 can rotate the pressure arm 43 in the clockwise direction in the drawing against the urging force of the torsion spring 42 by pressing the pressure arm 43. Therefore, the state in which the feed pressure lever 37 is positioned by the separation rib 43S of the pressure arm 43 and the state in which the pressure rib 43P of the pressure arm 43 presses the feed pressure lever 37 by the urging force of the torsion spring 42 are switched according to the rotation angle of the control cam 41. In other words, the state in which the feed pressure lever 37 is positioned by the separation rib 43S of the pressure arm 43 and the state in which the pressure rib 43P of the pressure arm 43 presses the feed pressure lever 37 by the urging force of the torsion spring 42 are switched by the rotation of the control cam 41.

The torsion spring 42 functions as an urging member that generates a contact pressure of the feed roller 21 with respect to the sheet S in the sheet feeding operation. In addition, in the sheet feeding operation, the torsion spring 42 enables the feed arm 29 to swing such that the contact of the feed roller 21 with the sheet S is maintained following the change in the stacking amount of the sheet S on the feed tray 24. Instead of the torsion spring 42, another elastic member may be used as the urging member. For example, by stretching a tension coil spring in an appropriate direction between the pressure arm 43 and the drive frame 45, it is possible to generate an urging force for pressing the feed pressure lever 37 by the pressure rib 43P with respect to the pressure arm 43.

The torsion spring 42 as an urging member that generates a pressing force, the pressure arm 43 as a pressing member that is urged by the torsion spring 42, and the feed pressure lever 37 as a swinging member that is pressed by the pressing member constitute an urging mechanism (pressurizing unit that pressurizes the feed arm 29, in other words) that urges the feed arm 29. In the first embodiment, the feed pressure lever 37 is disposed at the end portion on one side of the feed arm 29 in the X direction, and the pressure arm 43 swings about the axis parallel to the axis A1 of the feed arm 29. That is, the elements constituting the urging mechanism are arranged so as to each operate with an in-plane movement in a plane substantially perpendicular to the sheet width direction on one side in the sheet width direction with respect to the feed unit 19. In other words, the rotation axis of the pressure arm 43 extends in the direction of the rotation axis of the feed arm 29. Therefore, when viewed in a direction orthogonal to the rotation axis of the feed arm 29, the direction of the rotation axis of the pressure arm 43 intersects (preferably orthogonal to) the moving direction of the feed arm 29. When viewed in a direction orthogonal to the rotation axis of the pressure arm 43, the direction of the rotation axis of the feed arm 29 intersects (preferably orthogonal to) the moving direction of the pressure arm 43. In the first embodiment, the direction of the rotation axis of the feed arm 29 and the direction of the rotation axis of the pressure arm 43 are parallel. Therefore, the urging mechanism for urging the feed arm 29 can be compactly disposed at a place not interfering with the conveyance path of the sheet S.

Sheet Feeding Operation

Figure 6C:
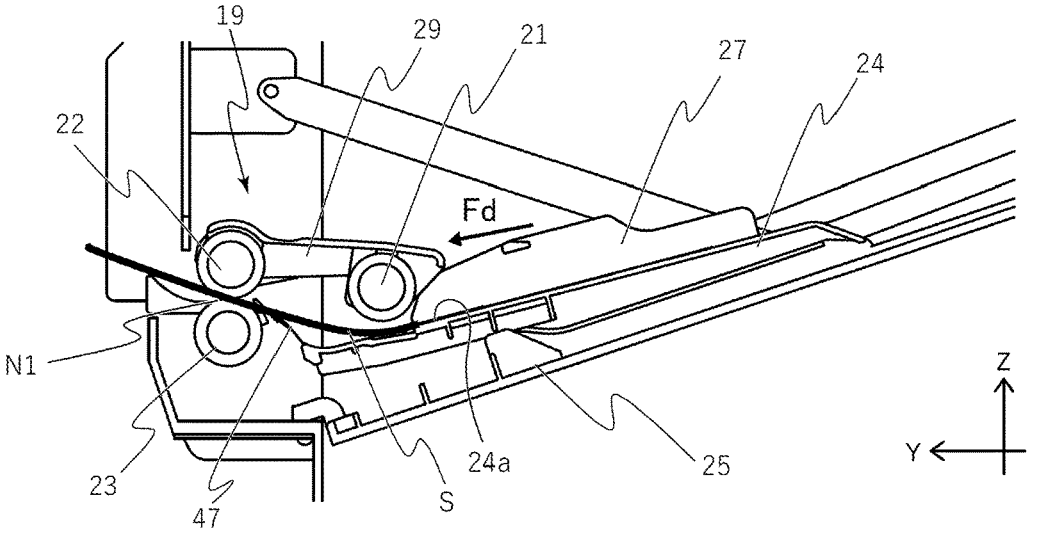

Next, a series of movements of the feed drive mechanism 19D and the feed unit 19 at the time of the sheet feeding operation will be described with reference to FIGS. 6A to 6C and FIGS. 7A to 7C. FIGS. 6A to 6C are cross-sectional views of the manual feed unit 12 in a plane perpendicular to the X direction, and illustrate a process of a sheet feeding operation in which one sheet S on the feed tray 24 is fed toward the apparatus body 1A. FIG. 6A illustrates a standby state before the sheet feeding operation is started, FIG. 6B illustrates a state in which the feed roller 21 contacting the sheet S, and FIG. 6C illustrates a state in which the feed roller 21 starts to be separated from the sheet S. In addition, FIGS. 7A to 7C are side views of the feed drive mechanism 19D when viewed in the X direction, and FIGS. 7A, 7B, and 7C illustrate states of the feed drive mechanism 19D corresponding to the states of the feed unit 19 in FIGS. 6A, 6B, and 6C, respectively.

First, a standby state before the start of the sheet feeding operation will be described with reference to FIGS. 6A and 7A. As illustrated in FIG. 6A, in the standby state, the feed roller 21 is held at a standby position separated upward from the sheet S on the feed tray 24. Specifically, the feed roller 21 is positioned above a stacking upper limit line Lp which is the maximum height (i.e., maximum loading amount, stacking upper limit) of the sheet S that can be loaded on the feed tray 24. The stacking upper limit line Lp is a straight line parallel to the loading surface 24*a* of the feed tray 24, and is a straight line in contact with a lower surface of a full stack upper limit claw 27L provided so as to protrude inward in the sheet width direction (i.e., X direction) from the side regulating plate 27. Note that, instead of the configuration in which the maximum loading amount of the sheets S on the feed tray 24 is regulated by the full stack upper limit claw 27L physically interfering with the sheets S, the maximum loading amount may be displayed by arranging a figure or a character on the side regulating plate 27.

Figure 7A:
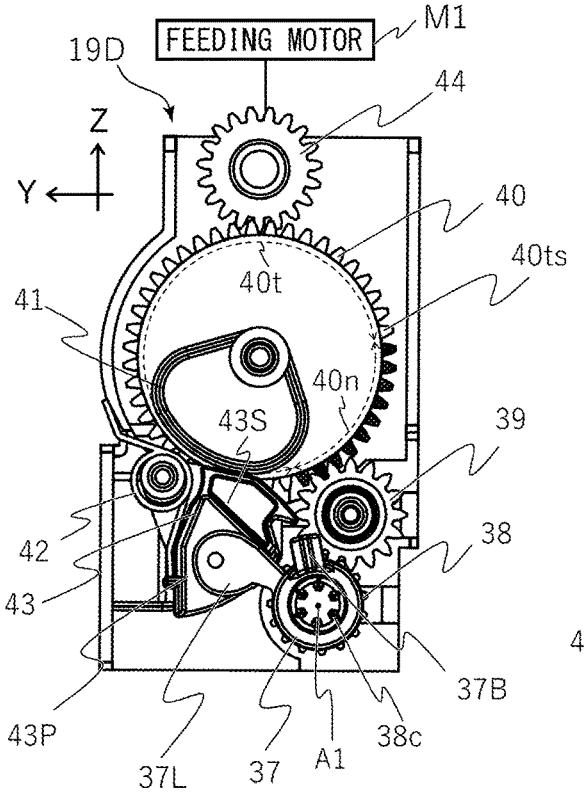
FIGS. 7A to 7C are each a cross-sectional view of a feed drive mechanism illustrating the process of the feeding operation according to the first embodiment.
Figure 7B:
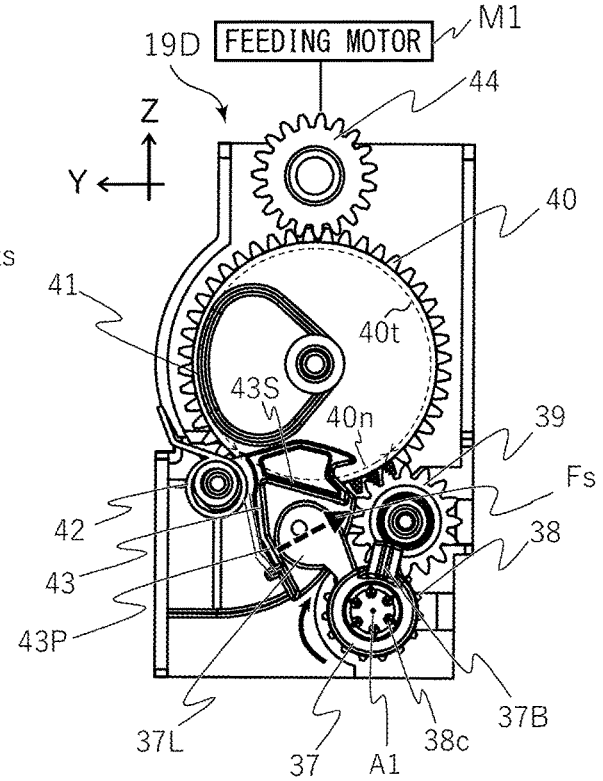
Figure 7C:
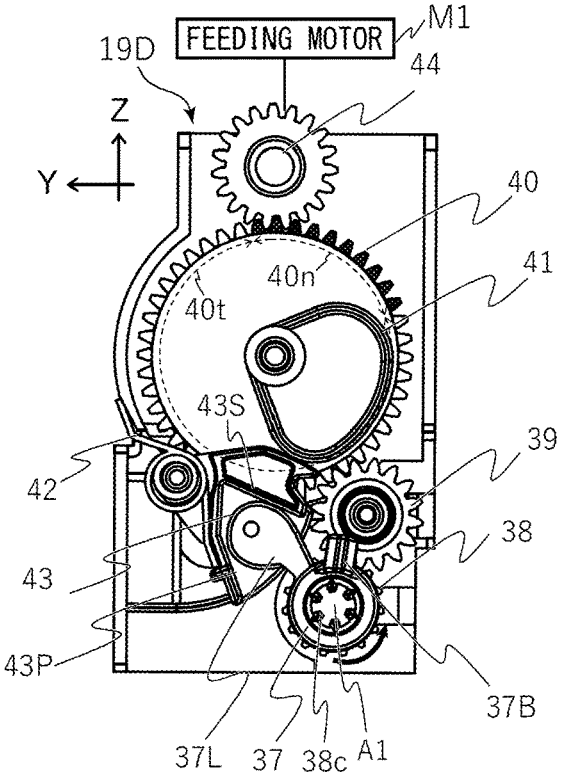

In the standby state illustrated in FIG. 7A, the feed motor M1 is maintained in the rotation stop state, and the input gear 44 and the partially-toothless gear 40 are held in the illustrated rotation phase. In this rotational phase, the toothless region 40*n* of the partially-toothless gear 40 faces the idler gear 39. In addition, the control cam 41 integrated with the partially-toothless gear 40 presses the pressure arm 43 in the clockwise direction in the drawing against the urging force of the torsion spring 42, and maintains the pressure arm 43 at the illustrated position.

By the way, the feed pressure lever 37 is connected to the feed arm 29 by fitting the boss 37B described above into the groove 29U of the arm engaged portion 29C. On the other hand, the urging force (or moment) in the clockwise direction in FIGS. 6A and 7A in the drawing acts on the feed arm 29 around the feed shaft 30 by the weight of the feed unit 19. Therefore, the urging force in the clockwise direction in FIG. 7A acts on the feed pressure lever 37 from the feed unit 19. Here, since the pressure arm 43 is positioned by the control cam 41, the lever portion 37L of the feed pressure lever 37 urged in the clockwise direction in the drawing by the feed unit 19 is received by the separation rib 43S, and the position of the feed pressure lever 37 is maintained. That is, in the standby state, the pressure arm 43 and the feed pressure lever 37 are positioned by the control cam 41, thereby the feed roller 21 is held at the standby position illustrated in FIG. 6 by the feed arm 29 engaged with the feed pressure lever 37.

Next, an operation of bringing the feed roller 21 into contact with the sheet S during the execution of the sheet feeding operation will be described with reference to FIGS. 6B and 7B. As illustrated in FIG. 7B, the rotation of the feed motor M1 starts at the start of the sheet feeding operation, and the partially-toothless gear 40 rotates in the clockwise direction in the drawing by the driving force transmitted via the input gear 44. As the partially-toothless gear 40 rotates, the control cam 41 integrated with the partially-toothless gear 40 rotates to a position separated from the pressure arm 43. As a result, the pressure arm 43 released from the positioning by the control cam 41 rotates in the counterclockwise direction in the drawing by the urging force of the torsion spring 42.

Due to the rotation of the pressure arm 43, the pressure rib 43P of the pressure arm 43 contacts the lever portion 37L of the feed pressure lever 37, and presses the lever portion 37L with a force Fs. The force Fs is a force acting on the lever portion 37L from the pressure rib 43P at the contact position between the pressure rib 43P and the lever portion 37L. Due to the force Fs received from the pressure rib 43P, the feed pressure lever 37 rotates in the clockwise direction in the drawing. Further, the feed arm 29 engaged with the feed pressure lever 37 rotates integrally with the feed pressure lever 37.

As illustrated in FIG. 6B, when the feed arm 29 rotates in the clockwise direction in the drawing together with the feed pressure lever 37, the feed roller 21 contacts the sheet S on the feed tray 24. The magnitude of the pressing force Fp by which the feed roller 21 presses the sheet S in this state will be described below.

In addition, when the rotation of the feed motor M1 is continued even after the feed roller 21 contacts the sheet S, the toothed region 40*t* of the partially-toothless gear 40 meshes with the idler gear 39 from the state of FIG. 7B in the feed drive mechanism 19D, and the driving of the idler gear 39 starts. Then, when the feed drive gear 38 meshing with the idler gear 39 rotates, the feed shaft 30 connected to the feed drive gear 38 via the feed coupling 32 rotates, and the conveyance roller 22 attached to the feed shaft 30 rotates. Further, since the driving force is transmitted from the conveyance roller 22 to the feed roller 21 via the idler gear 34, the feed roller 21 rotates. As a result, the sheet S in contact with the feed roller 21 is conveyed in the sheet feeding direction toward the separation nip N1.

Here, as described above, the conveyance guide 47 inclined with respect to the extension line L24*a* of the loading surface 24*a* is provided between the feed roller 21 and the separation nip N1. Therefore, the sheet S fed by the feed roller 21 is guided toward the separation nip N1 while climbing the conveyance guide 47. In this case, as the stacking height of the sheet S on the feed tray 24 decreases, the height at which the sheet S climbs the conveyance guide 47 increases, and thus the conveyance resistance received by the sheet S from the conveyance guide 47 increases. The height at which the sheet S climbs is a distance from a position where the leading end of the sheet S fed by the feed roller 21 first comes into contact with the conveyance guide 47 to the separation nip N1 in a direction perpendicular to the extension line L24*a* of the loading surface 24*a*.

Therefore, the lower the stacking height of the sheet S in the feed tray 24, the larger the conveying force required for the feed roller 21 in order for the sheet S to overcome the conveyance resistance and reach the separation nip N1. Note that the conveying force of the feed roller 21 is a frictional force in the sheet feeding direction Fd acting on the sheet S at a contact portion between the feed roller 21 and the uppermost sheet S. That is, the conveying force of the feed roller 21 is the product of the pressing force Fp (normal force) of the feed roller 21 on the sheet S and the friction coefficient between the feed roller 21 and the sheet S. In the following description, it is assumed that the friction coefficient is constant.

Next, a process in which the feed roller 21 is separated from the sheet S will be described with reference to FIGS. 6C and 7C. As illustrated in FIG. 7C, when the partially-toothless gear 40 rotates in the clockwise direction by a predetermined angle from the state of FIG. 7B, the control cam 41 comes into contact with the pressure arm 43 again. Then, the pressure arm 43 pressed by the control cam 41 rotates in the clockwise direction in the drawing against the urging force of the torsion spring 42. As a result, the pressure rib 43P of the pressure arm 43 is separated from the lever portion 37L of the feed pressure lever 37, and instead, the separation rib 43S of the pressure arm 43 contacts the lever portion 37L. By pressing the lever portion 37L against the separation rib 43S, the feed pressure lever 37 rotates in the counterclockwise direction in the drawing. As a result, as illustrated in FIG. 6C, the feed arm 29 that rotates integrally with the feed pressure lever 37 also rotates in the counterclockwise direction in the drawing around the rotation axis of the conveyance roller 22, and the feed roller 21 supported by the feed arm 29 is separated upward from the sheet S.

Thereafter, when the partially-toothless gear 40 makes one rotation from the state of FIG. 7A, the feed unit 19 and the feed drive mechanism 19D return to the standby state illustrated in FIGS. 6A and 7A. As described above, every time the feed motor M1 is driven by the rotation amount corresponding to one rotation of the partially-toothless gear 40, the sheet feeding operation is executed in a series of processes described with reference to FIGS. 6A to 6C and FIGS. 7A to 7C.

Pressing Force of Feed Roller

Figure 8A:
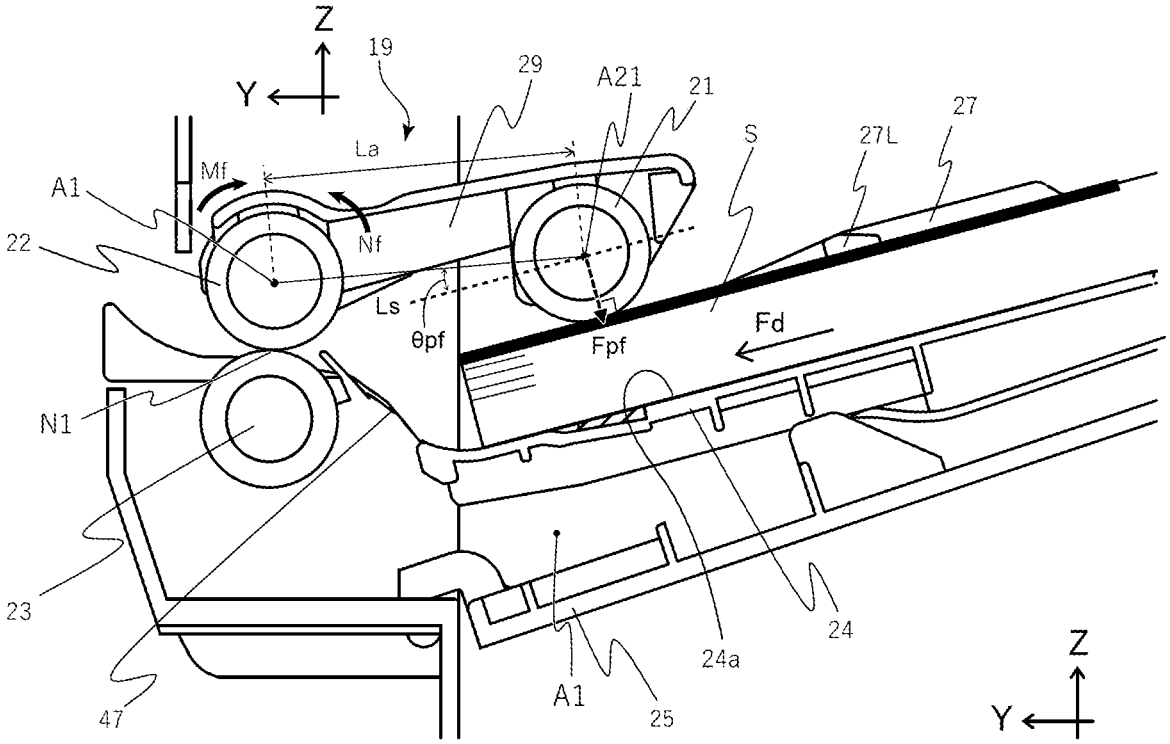
FIGS. 8A and 8B are each a cross-sectional view of the manual feed unit in a full stack state and a near empty state of a feed tray in the first embodiment.
Figure 8B:
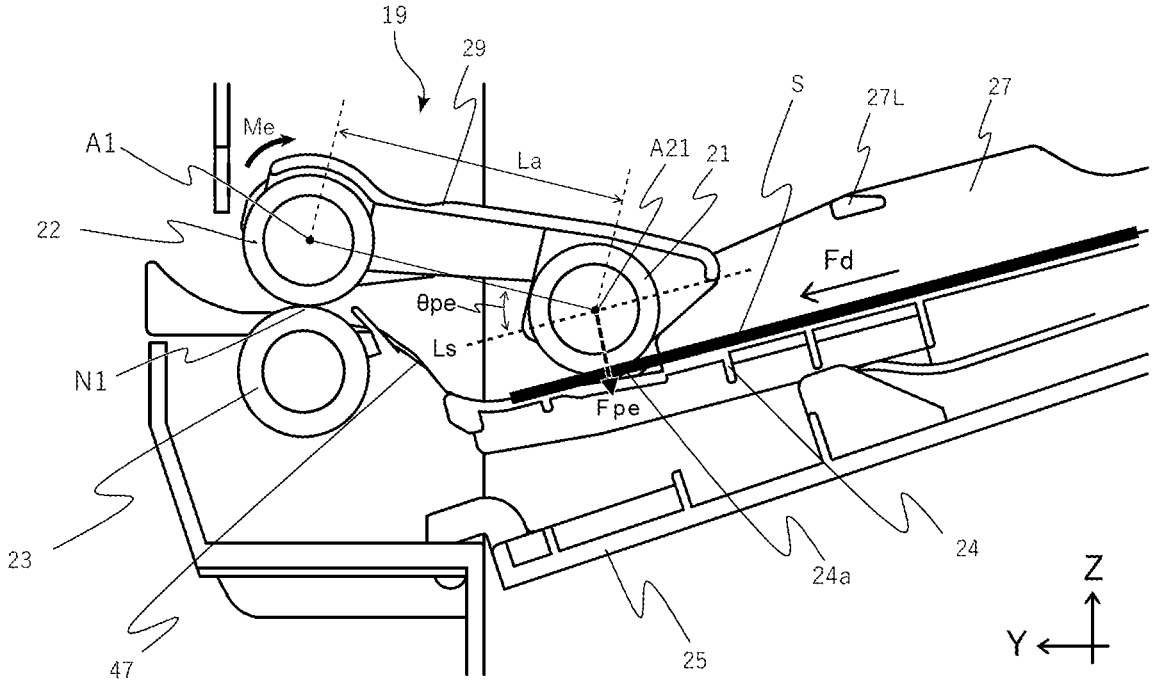

Next, a configuration for generating the pressing force on the sheet S by the feed roller 21 will be described in more detail with reference to FIGS. 8A and 8B and 9A and 9B. FIG. 8A is a diagram for describing a pressing force Fpf of the feed roller 21 when the sheet feeding operation is performed in the full stack state. The "full stack state" refers to a state (i.e., second state) in which the maximum loading amount of the sheet S is stacked on the feed tray 24. In addition, FIG. 8B is a diagram for describing a pressing force Fpe of the feed roller 21 when the sheet feeding operation is performed in the near empty state. The "near empty state" refers to a state in which only one sheet S is placed on the feed tray 24. In addition, FIGS. 9A and 9B each illustrate a state in which the feed drive mechanism 19D corresponding to the state of FIGS. 8A and 8B is viewed in the X direction.

First, the pressurization state of the feed roller 21 and the pressing force Fpf in the full stack state will be described with reference to FIGS. 8A and 9A. In FIG. 8A, the sheet S is stacked on the feed tray 24 up to substantially the same height as the lower surface of the full stack upper limit claw 27L of the side regulating plate 27. Therefore, the feed roller 21 is in contact with the upper surface of the uppermost sheet S at the pressing force Fpf at the position separated from the loading surface 24*a* of the feed tray 24 by the height corresponding to the maximum loading amount.

Figure 9A:
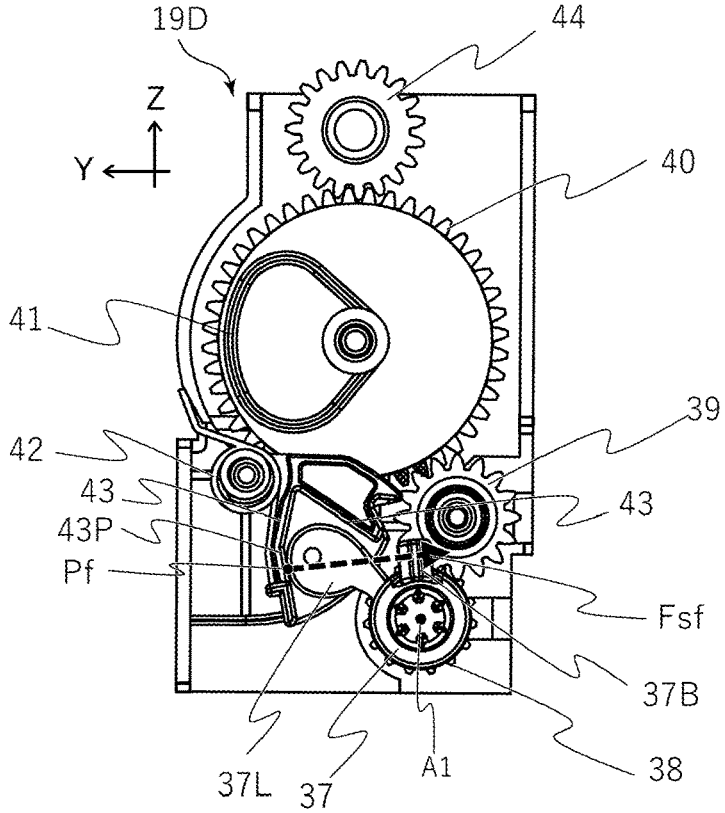
FIGS. 9A and 9B are each a schematic diagram of a feed drive mechanism corresponding to the full stack state and the near empty state of the feed tray in the first embodiment.

In the feed drive mechanism 19D illustrated in FIG. 9A, the pressure arm 43 presses the feed pressure lever 37 with a pressing force (i.e., second force) Fsf. In this case, a distance (i.e., second length) between the action line of the pressing force Fsf and the axis A1 of the feed pressure lever 37 is defined as Rf. The action line of the pressing force Fsf is a straight line that passes through the contact position between the pressure rib 43P and the lever portion 37L and is drawn in the direction of the pressing force Fsf. A direction of a pressing force Lsf is a direction perpendicular to the contact surface of the pressure rib 43P with respect to the lever portion 37L. In this case, a moment Mf (FIG. 8A) of the force around the axis A1 applied to the feed pressure lever 37 is expressed by Fsf×Rf.

As illustrated in FIG. 8A, the moment Mf of the force acts on the feed arm 29 as a moment around the axis A1 which is a swing center of the feed arm 29 through the engagement between the feed pressure lever 37 and the arm engaged portion 29C. In FIG. 8A, a distance from the axis A1 to the rotation axis A21 of the feed roller 21 is denoted by La, and an angle formed by a straight line connecting the axis A1 and the rotation axis A21 of the feed roller 21 and the upper surface of the uppermost sheet S is denoted by θpf. Note that the straight line Ls in the drawing is parallel to the upper surface of the uppermost sheet S. In this case, the pressing force Fpf (component perpendicular to the sheet S) applied to the sheet S by the feed roller 21 is expressed by the following Equation (1).

$$Fpf=Fsf\times Rf/(La\times\cos(\theta pf)) \quad (1)$$

Equation (1) is derived from the balance condition of the moment of the force acting on the feed arm 29 around the axis A1. That is, when the moment of the force in the counterclockwise direction in the drawing acting on the feed arm 29 by a reaction force (i.e., force in the opposite direction with the same magnitude as the pressing force Fpf) received by the feed roller 21 from the sheet S is Nf, Nf is expressed by the following Equation (1a).

$$Nf=La\times Fpf\times\cos(\theta pf) \quad (1a)$$

After the feed roller 21 lands on the sheet S in the sheet feeding operation, the feed arm 29 can be considered to be stationary until the feed roller 21 is returned to the standby position, and thus, the magnitude of Mf is equal to the magnitude of Nf. Therefore, the following formula (1b) is established. Equation (1) is obtained by arranging Equation (1b) for Fpf.

$$La\times Fpf\times\cos(\theta pf)=Fsf\times Rf \quad (1b)$$

Next, the state of pressurization and the pressing force Fpe of the feed roller 21 in the near empty state will be described with reference to FIGS. 8B and 9B. In FIG. 8B, only one sheet S is loaded on the loading surface 24*a* of the feed tray 24. Therefore, the feed roller 21 is in contact with the upper surface of the sheet S with the pressing force Fpe at substantially the same height as the loading surface 24*a* of the feed tray 24.

Figure 9C:
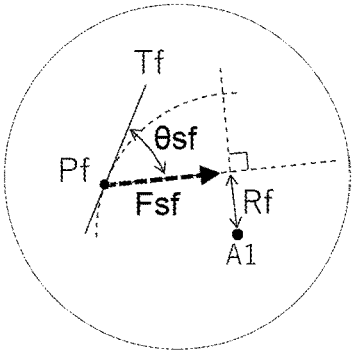
FIGS. 9C and 9D are each a schematic diagram for describing a direction in which a pressing force acts.
Figure 9B:
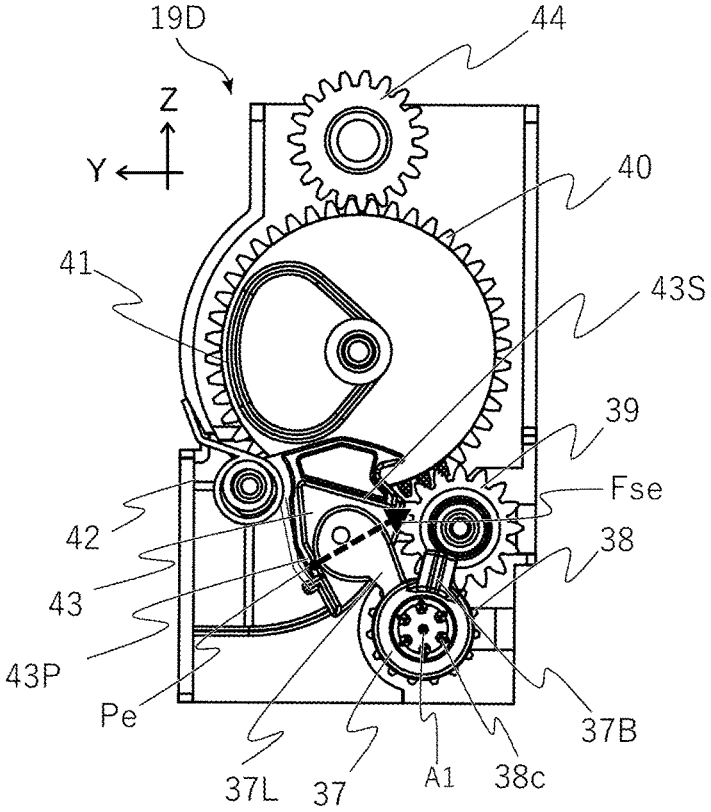

In the feed drive mechanism 19D illustrated in FIG. 9B, the pressure arm 43 presses the feed pressure lever 37 with a pressing force (i.e., first force) Fse. In this case, a distance (i.e., first length) between the action line of the pressing force Fse and the axis A1 of the feed pressure lever 37 is defined as Re. The action line of the pressing force Fse is a straight line that passes through the contact position between the pressure rib 43P and the lever portion 37L and is drawn in a direction of a pressing force Lse. The direction of the pressing force Lse is a direction perpendicular to the contact surface of the pressure rib 43P with respect to the lever portion 37L. In this case, a moment Me of the force around the axis A1 applied to the feed pressure lever 37 is expressed by Fse×Re.

The moment Me of the force acts on the feed arm 29 around the axis A1 which is the swing center of the feed arm 29 as illustrated in FIG. 8B via the engagement between the feed pressure lever 37 and the arm engaged portion 29C of the feed arm 29. In FIG. 8B, a distance from the axis A1 to the rotation axis A21 of the feed roller 21 is denoted by La, and an angle formed by a straight line connecting the axis A1 and the rotation axis A21 of the feed roller 21 and the upper surface of the uppermost sheet S is denoted by θpf. Note that the straight line Ls in the drawing is parallel to the upper surface of the uppermost sheet S. In this case, the pressing force Fpe (component perpendicular to the sheet S) applied to the sheet S by the feed roller 21 is expressed by the following Equation (2). Equation (2) is also derived from the balance condition of the moment of the force acting on the feed arm 29 around the axis A1, but since it is similar to the case of equation (1), the description thereof is omitted.

$$Fpe=Fse\times Re/(La\times\cos(\theta pe)) \quad (2)$$

Here, the pressing force Fpf applied to the sheet S by the feed roller 21 in the case where the feed tray 24 is in the full stack state is compared with the pressing force Fpe applied to the sheet S by the feed roller 21 in the case where the feed tray 24 is in the near empty state. As can be seen by comparing FIGS. 9A and 9B, the distance Re from the axis A1 to the action line of the pressing force Fse in the near empty state (FIG. 9B) is remarkably larger than the distance Rf from the axis A1 to the action line of the pressing force Fsf in the full stack state (FIG. 9A). In other words, as the stacking amount of the sheet S on the feed tray 24 decreases, the lengths (Rf and Re) of the arm of the moment Mf and Me of the force acting on the feed pressure lever 37 becomes longer as the pressure arm 43 presses the feed pressure lever 37. In other words, when viewed in the direction of the swinging axis of the holding member, the distance Re (i.e., first length) from the swinging axis to the action line of the force by which the pressing member presses the swinging member in the first state is larger than the distance Rf (i.e., second length) from the swinging axis to the action line of the force by which the pressing member presses the swinging member in the second state.

This is because the rotation angle of the pressure arm 43 when the pressure rib 43P contacts the lever portion 37L is different between the full stack state (FIG. 9A) and the near empty state (FIG. 9B), and thus, the directions of the pressing forces Fsf and Fse are different. That is, as the stacking amount of the sheet S on the feed tray 24 decreases, the directions of the pressing forces Fsf and Fse by which the pressure rib 43P presses the lever portion 37L change so as to be separated from the axis A1 of the feed pressure lever 37.

Figure 9D:
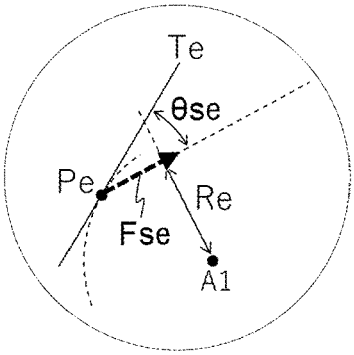

Here, in the full stack state, the contact position between the pressure rib 43P and the lever portion 37L is defined as a point Pf, a tangent line passing through the point Pf of an arc centered on the axis A1 is defined as Tf, and an angle between the pressing force Fsf and the tangent line Tf is defined as θsf (FIG. 9C). Similarly, in the near empty state, the contact position between the pressure rib 43P and the lever portion 37L is defined as a point Pe, the tangent line passing through the point Pe of an arc centered on the axis A1 is defined as Te, and the angle between the pressing force Fse and the tangent line Te is defined as θse (FIG. 9D). In this case, the relationship in which the directions of the pressing forces Fsf and Fse are separated from the axis A1 as the stacking amount of the sheets S decreases can be rephrased as θse<θsf. That is, as the stacking amount of the sheets S decreases, the direction of the pressing forces Fsf and Fse by which the pressure arm 43 presses the feed pressure lever 37 approaches the direction of the tangent lines Tf and Te of the arcs centered on the axis A1. In other words, in the first state, the direction of the force Fse by which the pressing member presses the swinging member intersects the tangent line Te at a first angle θse when viewed in the direction of the swinging axis of the holding member, where the tangent line Te as a first tangent line is tangent to the arc centered on the swinging axis at the contact position Pe between the pressing member and the swinging member. In the second state, the direction of the force Fsf by which the pressing member presses the swinging member intersects the tangent line Tf at a second angle θsf larger than the first angle when viewed in the direction of the swinging axis, where the tangent line Tf as a second tangent line is tangent to the arc centered on the swinging axis at the contact position Pf between the pressing member and the swinging member.

On the other hand, the magnitude of the pressing force Fse by which the pressure arm 43 presses the feed pressure lever 37 in the near empty state (FIG. 9B) is smaller than the magnitude of the pressing force Fsf by which the pressure arm 43 presses the feed pressure lever 37 in the full stack state (FIG. 9A). This is because, since the pressing forces Fsf and Fse are forces generated by the torsion spring 42, the elastic deformation amount of the torsion spring 42 is smaller (closer to a free state) in the near empty state than in the full stack state, and the restoring force acting on the pressure arm 43 is also smaller.

In addition, the angles θpf and θpe formed by the straight line connecting the axis A1 of the feed arm 29 and the rotation axis A21 of the feed roller 21 and the upper surface of the sheet S on the feed tray 24 are larger in the near empty state than in the full stack state (θpf<θpe). That is, cos(θpe) <cos(θpf). Note that θpf is usually a value larger than 0°. This is because, when θpf is a negative value, the extension line of the uppermost sheet of the sheet in the full stack state is conveyed upward from the separation nip N1, and the sheet comes into contact with, for example, the feed shaft 30 or the feed arm 29, therefore conveyance failure is likely to occur.

In summary, in the second embodiment, the following relationships (A) to (C) are established for the elements of the formulas (1) and (2) that affect the pressing forces Fpf and Fpe of the feed roller 21 on the sheet S. Among (A) to (C), the relationship of (A) and (C) has an effect of increasing the ratio of Fse to Fsf, and the relationship of (B) has an effect of decreasing the ratio of Fse to Fsf.

$$Re>Rf \tag{A}$$

$$Fse<Fsf \tag{B}$$

$$La\times\cos(\theta pe)<La\times\cos(\theta pf) \tag{C}$$

Here, when designing the actual feed unit 19 and the feed drive mechanism 19D, it is relatively easy to arrange the pressure arm 43 and the feed pressure lever 37 so as to satisfy the relationship of (A). In the configuration example of the first embodiment, Re is about twice Rf, and Re may be twice or more Rf. Re is preferably 1.1 times or more Rf. In order not to make the difference between Fpf and Fpe too large, Re is preferably three times or less Rf.

On the other hand, even if Fse is smaller than Fsf, the torsion spring 42 can be designed such that the ratio (Fsf/Fse) of Fsf and Fse is smaller than the ratio (Re/Rf) of Re and Rf. For example, it is conceivable to use a spring having a smaller spring constant as the torsion spring 42. In this case, if the torsion spring 42 is attached so as to obtain a desired pressing force Fsf in the full stack state (FIG. 9A), a decrease width of the pressing force Fse when the full stack state changes to the near empty state decreases by an amount corresponding to the decrease in the spring constant, and Fsf/Fse approaches 1.

In addition, since there is the relationship of (C), if (Fsf×Rf) and (Fse×Re) are equal, Fpe becomes a value larger than Fpf That is, if Re×Fse>Rf×Fsf is satisfied, the relationship of Fpe>Fpf is established. Note that, in the first embodiment, the product of Re and Fse is larger than the product of Rf and Fsf.

Therefore, even in a case where the above elements (A) to (C) are taken into consideration, the manual feed unit 12 can be designed to satisfy the relationship of the following Equation (3).

$$Fpe>Fpf \tag{3}$$

As described above, in the first embodiment, in the configuration in which the inclined conveyance guide 47 is disposed downstream of the loading surface 24*a* of the feed tray 24, in the case where the stacking amount of the sheets S on the feed tray 24 decreases, the pressing force on the sheet S by the feed roller 21 increases. That is, (i) the force by which the feeding member presses the upper surface of the sheet in the first state in which the distance between the loading surface and the feeding member is the first distance is larger than (ii) the force by which the feeding member presses the upper surface of the sheet in the second state in which the distance between the loading surface and the feeding member is the second distance longer than the first distance. The near empty state is an example of the first state in which a relatively small amount of sheets are loaded on the feed tray 24, and the full stack state is an example of the second state in which more sheets than in the first state are loaded on the feed tray 24. In addition, an example of the "first distance" is a distance (thickness of one sheet) from the loading surface 24*a* to the feed roller 21 in the near empty state. In addition, an example of the "second distance" is a distance from the loading surface 24*a* to the feed roller 21 in the full stack state (i.e., height corresponding to the maximum loading amount of the sheets S on the feed tray 24).

With such a configuration, in a state in which the stacking amount of the sheets S on the feed tray 24 is small, as compared with the state in which the stacking amount of the sheets S, the pressing force applied by the feed roller 21 to press the sheets S becomes large (In FIGS. 8A and 8B, Fpe>Fpf) is large. That is, in the state in which the stacking amount of the sheets S on the feed tray 24 is small, the conveying force, which is the frictional force applied from the feed roller 21 to the sheet S, becomes large, and the conveying force necessary for causing the sheet S to climb the conveyance guide 47 is reliably obtained. Therefore, the sheet S can be stably fed even in a state in which the stacking amount of the sheet S is reduced.

In addition, according to the first embodiment, for example, it is easy to cope with a sheet (such as a thick paper) having a large grammage or a sheet having high stiffness, even though the conveyance resistance of such a sheet is often large regardless of the stacking amount of the sheet S. That is, in the case where a sheet such as a thick sheet is fed, when the stacking amount of the sheet S on the feed tray 24 becomes small, an increase in conveyance resistance due to a long climbing distance of the conveyance guide 47 is added to the conveyance resistance of the sheet itself. According to the first embodiment, it is possible to feed the sheet more stably under such disadvantageous conditions.

Note that, as an alternative configuration to the first embodiment, it is conceivable to set the pressing force of the feed roller 21 in the full stack state to a large value such that a sufficient pressing force is maintained even if the pressing force of the feed roller 21 decreases due to the decrease in the stacking amount of the sheets S. However, in this configuration, the pressing force of the feed roller 21 in the full stack state becomes excessive, and another underlying sheet S is dragged by the uppermost sheet S directly contacting the feed roller 21 and conveyed, therefore double feeding and feeding failure are likely to occur. On the other hand, according to the first embodiment, there is an advantage that it is possible to ensure an appropriate conveying force in the near empty state while avoiding the pressing force of the feed roller 21 from becoming excessive in the full stack state.

In addition, the increase amount of the pressing force Fpe of the feed roller 21 in the near empty state with respect to the pressing force Fpf of the feed roller 21 in the full stack state may be appropriately set such that the feeding failure would not occur when the sheet S is actually fed. Therefore, the increase amount of Fpe with respect to Fpf is not particularly limited, but as an example, Fpe is preferably 1% or more larger than Fpf, more preferably 5% or more larger than Fpf, and still more preferably 10% or more larger than Fpf Fpe is preferably 300% or less, and more preferably 200% or less of Fpf.

Second Embodiment

Next, an image forming apparatus according to a second embodiment will be described. The second embodiment is different from the first embodiment in a mechanism for generating a pressing force on a sheet S by a feed roller 21. Hereinafter, elements denoted by the same reference numerals as those in the first embodiment will be described as having substantially the same configuration and operation as those described in the first embodiment.

Figure 10:
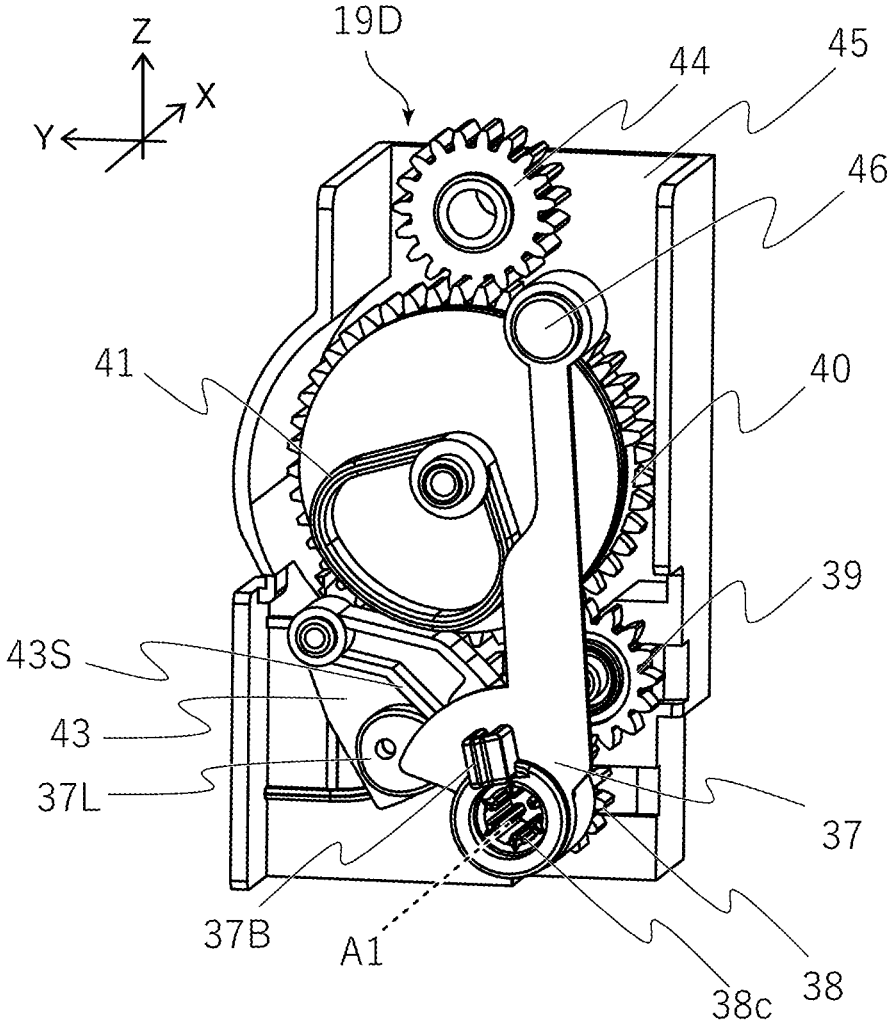
FIG. 10 is a perspective view of a feed drive mechanism according to a second embodiment.

FIG. 10 is a perspective view illustrating a feed drive mechanism 19D according to the second embodiment. The feed drive mechanism 19D is a mechanism for driving a feed unit 19 of a manual feed unit 12 in the image forming apparatus 1, similarly to the first embodiment. In the first embodiment, a pressing force of the feed roller 21 is generated using a torsion spring 42, but in the second embodiment, the pressing force of the feed roller 21 is generated using the weight.

As illustrated in FIG. 10, a weight 46 is attached to a feed pressure lever 37 according to the second embodiment. The weight 46 is attached to the feed pressure lever 37 so as to generate a moment of force in a clockwise direction in the drawing, including a standby state before feeding. In other words, a center of the weight 46 is located on a right side of an axis A1 in a Y direction in both standby positions (FIG. 6A) of the feed roller 21 and the state (FIG. 6B) in which the feed roller 21 is substantially in contact with a feed tray 24. Further, due to a weight of the weight 46, a lever portion 37L of the feed pressure lever 37 is always in contact with a separation rib 43S of a pressure arm 43.

The operations of each unit of the feed drive mechanism 19D during the sheet feeding operation are the same as those of the first embodiment except for the configuration of applying the pressing force to the feed pressure lever 37. That is, in the state after the start of the sheet feeding operation illustrated in FIG. 7B, in the first embodiment, the pressure arm 43 is urged by the torsion spring 42 to press the feed pressure lever 37, so as to rotate the feed pressure lever 37 in a direction (clockwise direction in FIG. 7B) in which the feed arm 29 descends. On the other hand, in the second embodiment, in a state in which a control cam 41 is separated from the pressure arm 43 after the start of the sheet feeding operation, the feed pressure lever 37 is urged by the weight of the weight 46, so as to rotate the feed pressure lever 37 in a direction in which the feed arm 29 descends. That is, in the second embodiment, the feed pressure lever 37 as a swinging member and the weight 46 attached to the feed pressure lever 37 constitute an urging mechanism that urges the feed arm 29. Since other processes in the sheet feeding operation are similar to those described with reference to FIGS. 6A to 6C and FIGS. 7A to 7C in the first embodiment, the description thereof will be omitted.

Figure 11A:
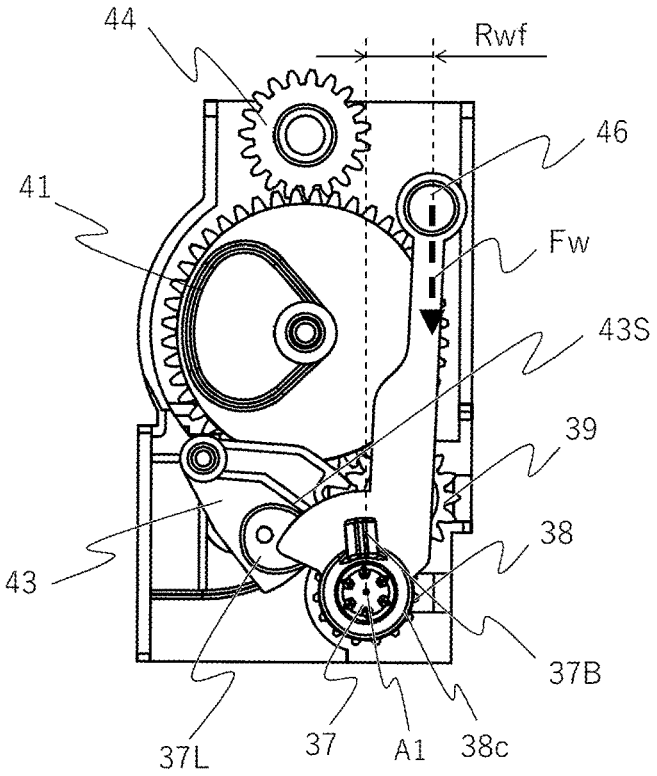
FIGS. 11A and 11B are perspective views of the feed drive mechanism in a case where a feed tray is full and in a case where the feed tray is near empty in the second embodiment.
Figure 11B:
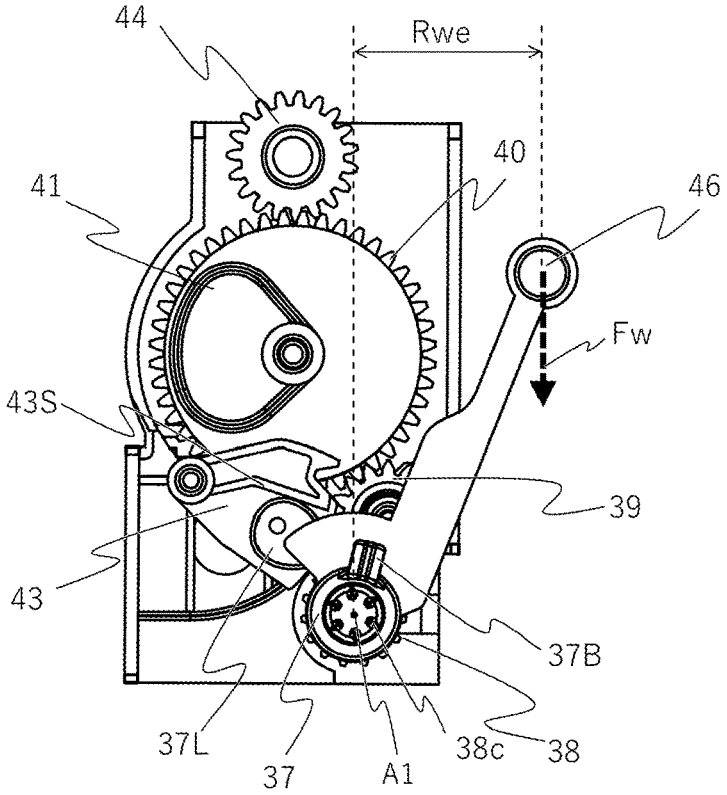

Next, the relationship between the stacking amount of the sheets S in the feed tray 24 and the pressing force applied to the sheet S by the feed roller 21 will be described with reference to FIGS. 11A and 11B. FIG. 11A illustrates a state of the feed drive mechanism 19D when the feed roller 21 contacts an uppermost sheet S (see FIG. 8A) in a case where the sheet feeding operation is executed in a full stack state. FIG. 11B illustrates a state of the feed drive mechanism 19D when the feed roller 21 contacts the sheet S (see FIG. 8B) in a case where the sheet feeding operation is executed in a near empty state.

In the full stack state illustrated in FIG. 11A, a moment Mf of a force in the clockwise direction in the drawing acts on the feed pressure lever 37 around the axis A1 due to a gravity Fw acting on the weight 46. In this case, when a distance between an action line of the gravity Fw of the weight 46 and the axis A1 of the feed pressure lever 37 is defined as Rwf, the moment Mf of the force applied to the feed pressure lever 37 is expressed by Fw×Rwf. As described in the first embodiment, the moment Mf of the force acts on the feed arm 29 from the feed pressure lever 37, and generates a pressing force Fpf of the feed roller 21 against the sheet S as illustrated in FIG. 8A. The pressing force Fpf is expressed by the following Equation (4). Note that definitions of θpf and La are the same as those in the first embodiment.

$$Fpf=Fw\times Rwf/(La\times\cos(\theta pf)) \quad (4)$$

On the other hand, even in the near empty state illustrated in FIG. 11B, the moment Me of the force in the clockwise direction in the drawing acts on the feed pressure lever 37 around the axis A1 due to the gravity Fw of the weight 46. In this case, when the distance between the action line of the gravity Fw of the weight 46 and the axis A1 of the feed pressure lever 37 is defined as Rwe, the moment Me of the force applied to the feed pressure lever 37 is expressed by Fw×Rwe. The moment Me of the force applied to the feed pressure lever 37 acts on the feed arm 29, and generates the pressing force Fpf on the sheet S of the feed roller 21 as illustrated in FIG. 8A. The moment Me of the force acts on the feed arm 29 from the feed pressure lever 37, and generates a pressing force Fpe on the sheet S of the feed roller 21 as illustrated in FIG. 8B. The pressing force Fpf is expressed by the following Equation (5). Note that definitions of θpf and La are the same as those in the first embodiment.

$$Fpe=Fw\times Rwe/(La\times\cos(\theta pe)) \quad (5)$$

Here, the pressing force Fpf of the feed roller 21 in the full stack state and the pressing force Fpe of the feed roller 21 in the near empty state are compared. As illustrated in FIGS. 11A and 11B, the distance Rwe from the axis A1 of the feed pressure lever 37 to the action line of the gravity Fw of the weight 46 in the near empty state is larger than the distance Rwf in the full stack state. In other words, when viewed in the direction of the swinging axis of the holding member, (i) the distance Rwe (i.e., third length) from the swinging axis to an action line of gravity acting on the weight in the first state is larger than (ii) the distance Rwf (i.e., fourth length) from the swinging axis to an action line of gravity acting on the weight in the second state. This is because the arrangement of the weight 46 in the feed pressure lever 37 is set such that the weight 46 moves in a direction away from the axis A1 in the Y direction by the rotation of the feed pressure lever 37 in the case where a stacking height of the sheets S on the feed tray 24 decreases.

In addition, the angles θpf and θpe formed by a straight line connecting the axis A1 of the feed arm 29 and the rotation axis A21 of the feed roller 21 and the upper surface of the sheet S on the feed tray 24 have a relationship of θpf<θpe as in the first embodiment.

In summary, in the second embodiment, the following relationships (D) and (E) are established for the elements in Equations (4) and (5) that affect the pressing forces Fpf and Fpe of the feed roller 21 on the sheet S.

$$Rwe>Rwf \quad (D)$$

$$La\times\cos(\theta pe)<La\times\cos(\theta pf) \quad (E)$$

As is clear from Equations (4) and (5), both of (D) and (E) have an effect of making Fpe smaller than Fpf Therefore, in the second embodiment, the pressing force Fpe of the feed roller 21 in the near empty state is larger than the pressing force Fpf of the feed roller 21 in the full stack state. That is, in the second embodiment, the relationship of the following expression (6) is satisfied.

$$Fpe>Fpf \quad (6)$$

As described above, even in the present embodiment, in the configuration in which the inclined conveyance guide 47 is disposed downstream of the loading surface 24*a* of the feed tray 24, in the case where the stacking amount of the sheets S on the feed tray 24 decreases, the pressing force on the sheet S by the feed roller 21 increases. That is, the force by which the feeding member presses the upper surface of the sheet when the distance between the loading surface and the feeding member is the first distance is larger than the force by which the feeding member presses the upper surface of the sheet in the case where the distance between the loading surface and the feeding member is the second distance longer than the first distance. As a result, as in the case of the first embodiment, in the state in which the stacking amount of the sheet S on the feed tray 24 is small, the pressing force by which the feed roller 21 presses the sheet S becomes large (In FIGS. 8A and 8B, Fpe>Fpf) as compared with the state in which the stacking amount of the sheet S is large. That is, in the state in which the stacking amount of the sheets S on the feed tray 24 is small, the conveying force, which is the frictional force applied from the feed roller 21 to the sheet S, becomes large, and the conveying force necessary for causing the sheet S to climb the conveyance guide 47 is reliably obtained. Therefore, the sheet S can be stably fed even in a state in which the stacking amount of the sheet S is reduced. In addition, it is possible to feed a sheet more stably such as a thick sheet in which the conveyance resistance tends to increase.

Other Examples

In the embodiment described above, the image forming apparatus 1 including the image forming unit 5 of the electrophotographic system as the image forming unit that forms an image on a sheet has been described, but other image forming methods may be used. For example, an inkjet type image forming unit that forms an image on a sheet by ejecting ink liquid from a nozzle may be used as the image forming unit.

In addition, in the above-described embodiment, the manual feed unit 12 provided on the side portion of the image forming apparatus 1 has been described, but the present technology may be applied to other sheet feeding apparatuses. For example, the present technology may be applied to an auto document feeder (ADF) that feeds sheets one by one from a document tray in order to read image information from a sheet as a document. In addition, the present technology may be applied to a sheet feeding apparatus that feeds a sheet material in the field of the image forming apparatus.

Other Embodiments

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-064531, filed on Apr. 6, 2021, which is hereby incorporated by reference herein in its entirety.

What is claimed is:

1. A sheet feeding apparatus comprising:

a sheet loading member including a loading surface on which a sheet is loaded;

a feeding member configured to feed the sheet loaded on the sheet loading member in a sheet feeding direction and disposed above the loading surface;

a holding member configured to hold the feeding member and move the feeding member toward and away from the loading surface;

an urging mechanism configured to urge the holding member to bring the feeding member into contact with an upper surface of the sheet loaded on the sheet loading member;

a conveyance unit disposed downstream of the feeding member in the sheet feeding direction, the conveyance unit including a separation nip by which the sheet fed from the feeding member is conveyed while being separated one by one; and a guide portion configured to guide a leading end of the sheet fed by the feeding member to the separation nip to guide the leading end upward from upstream to downstream in the sheet feeding direction, wherein the urging mechanism includes:

a swinging member connected to the holding member;

a pressing member configured to press the swinging member; and an urging member configured to urge the pressing member, wherein the swinging member and the holding member are configured to swing around a same swinging axis, wherein the holding member is configured to be urged in a direction that brings the feeding member into contact with the upper surface of the sheet in a state where the pressing member urged by the urging member presses the swinging member, wherein the urging mechanism is configured to urge the holding member so that (i) a first force by which the feeding member presses an upper surface of a sheet, in a first state where a distance between the loading surface and the feeding member is a first distance, is larger than (ii) a second force by which the feeding member presses an upper surface of a sheet, in a second state where the distance between the loading surface and the feeding member is a second distance that is longer than the first distance, and wherein, as viewed in a direction of the swinging axis, (i) a first length from the swinging axis to an action line of a third force by which the pressing member presses the swinging member in the first state is larger than (ii) a second length from the swinging axis to an action line of a fourth force by which the pressing member presses the swinging member in the second state.

2. The sheet feeding apparatus according to claim 1, wherein:

the swinging member is provided at an end portion of the holding member in a sheet width direction that is perpendicular to the sheet feeding direction, and the pressing member is configured to swing about an axis parallel to the swinging axis of the holding member.

3. The sheet feeding apparatus according to claim 2, wherein the urging member is a torsion coil spring disposed around the axis of the pressing member.

4. The sheet feeding apparatus according to claim 1, wherein a product of the third force and the first distance is larger than a product of the fourth force and the second distance.

5. The sheet feeding apparatus according to claim 1, wherein the pressing member includes:

a first pressing portion configured to press the swinging member so that the feeding member is moved in a direction toward the loading surface; and a second pressing portion configured to press the swinging member so that the feeding member is moved in a direction away from the loading surface.

6. The sheet feeding apparatus according to claim 1, wherein:

in the first state, a direction of the first force by which the pressing member presses the swinging member intersects a first tangent line at a first angle as viewed in a direction of the swinging axis, the first tangent line being tangent to an arc centered on the swinging axis at a contact position between the pressing member and the swinging member, and in the second state, a direction of the second force by which the pressing member presses the swinging member intersects a second tangent line at a second angle larger than the first angle as viewed in the direction of the swinging axis, the second tangent line being tangent to an arc centered on the swinging axis at a contact position between the pressing member and the swinging member.

7. The sheet feeding apparatus according to claim 1, further comprising:

a motor configured to supply driving force for driving the feeding member; and a cam member configured to be rotated by the driving force of the motor, wherein the cam member is configured to, by rotating, cause a switch between a state where the feeding member is held at a position in contact with a sheet by the holding member and a state where the feeding member is held at a position separated from a sheet by the holding member.

8. The sheet feeding apparatus according to claim 1, wherein:

as viewed in a sheet width direction that is perpendicular to the sheet feeding direction, the separation nip is positioned above an extension line of the loading surface, and as viewed in the sheet width direction, at least a part of the guide portion is inclined upward from upstream to downstream in the sheet feeding direction with respect to the extension line of the loading surface.

9. The sheet feeding apparatus according to claim 1, wherein:

the conveyance unit includes a conveyance roller attached to a rotating drive shaft, the holding member is configured to swing about the drive shaft, and the feeding member is a feed roller configured to be rotated by driving force supplied from the drive shaft.

10. The sheet feeding apparatus according to claim 1, wherein:

the sheet loading member is provided on an opening/closing member that is openable and closable with respect to an apparatus body of the sheet feeding apparatus, and the sheet loading member is configured to load a sheet on the loading surface in a state where the opening/closing member is opened.

11. The sheet feeding apparatus according to claim 1, wherein:

the first state is where only one sheet is loaded on the sheet loading member, and the second state is where a maximum loading amount of sheets loadable on the sheet loading member is loaded on the sheet loading member.

12. An image forming apparatus comprising:

the sheet feeding apparatus according to claim 1; and an image forming unit configured to form an image on a sheet fed by the sheet feeding apparatus.

13. A sheet feeding apparatus comprising:

a sheet loading member including a loading surface on which a sheet is loaded;

a feeding member configured to feed the sheet loaded on the sheet loading member in a sheet feeding direction and disposed above the loading surface;

a holding member configured to hold the feeding member and move the feeding member toward and away from the loading surface;

an urging mechanism configured to urge the holding member to bring the feeding member into contact with an upper surface of the sheet loaded on the sheet loading member;

a conveyance unit disposed downstream of the feeding member in the sheet feeding direction, the conveyance unit including a separation nip by which the sheet fed from the feeding member is conveyed while being separated one by one; and a guide portion configured to guide a leading end of the sheet fed by the feeding member to the separation nip to guide the leading end upward from upstream to downstream in the sheet feeding direction, wherein the urging mechanism includes:

a swinging member configured to swing together with the holding member about a swinging axis of the holding member; and a weight attached to the swinging member, wherein the holding member is configured to be urged in a direction that brings the feeding member into contact with the upper surface of the sheet by the swinging member being urged due to a gravity acting on the weight, and wherein the urging mechanism is configured to urge the holding member so that (i) a first force by which the feeding member presses an upper surface of a sheet, in a first state where a distance between the loading surface and the feeding member is a first distance, is larger than (ii) a second force by which the feeding member presses an upper surface of a sheet, in a second state where the distance between the loading surface and the feeding member is a second distance that is longer than the first distance.

14. The sheet feeding apparatus according to claim 13, wherein as viewed in a direction of the swinging axis, (i) a first length from the swinging axis to an action line of the gravity acting on the weight in the first state is larger than (ii) a second length from the swinging axis to an action line of the gravity acting on the weight in the second state.

15. The sheet feeding apparatus according to claim 13, further comprising:

a motor configured to supply driving force for driving the feeding member;

a pressing member configured to press the swinging member; and a cam member configured to be rotated by the driving force of the motor, wherein the cam member is configured to, by rotating, cause a switch between a state where the feeding member is held at a position in contact with a sheet by the holding member and a state where the feeding member is held at a position separated from a sheet by the holding member.

16. The sheet feeding apparatus according to claim 13, wherein:

as viewed in a sheet width direction that is perpendicular to the sheet feeding direction, the separation nip is positioned above an extension line of the loading surface, and as viewed in the sheet width direction, at least a part of the guide portion is inclined upward from upstream to downstream in the sheet feeding direction with respect to the extension line of the loading surface.

17. The sheet feeding apparatus according to claim 13, wherein:

the conveyance unit includes a conveyance roller attached to a rotating drive shaft, the holding member is configured to swing about the drive shaft, and the feeding member is a feed roller configured to be rotated by driving force supplied from the drive shaft.

18. The sheet feeding apparatus according to claim 13, wherein:

the sheet loading member is provided on an opening/closing member that is openable and closable with respect to an apparatus body of the sheet feeding apparatus, and the sheet loading member is configured to load a sheet on the loading surface in a state where the opening/closing member is opened.

19. The sheet feeding apparatus according to claim 13, wherein:

the first state is where only one sheet is loaded on the sheet loading member, and the second state is where a maximum loading amount of sheets that is loadable on the sheet loading member is loaded on the sheet loading member.

20. An image forming apparatus comprising:

the sheet feeding apparatus according to claim 13; and an image forming unit configured to form an image on a sheet fed by the sheet feeding apparatus.

* * * * *